US011268279B2

(12) United States Patent
Joseph

(10) Patent No.: US 11,268,279 B2
(45) Date of Patent: Mar. 8, 2022

(54) APPARATUS AND METHODS FOR TRUSS ASSEMBLY

(71) Applicant: Edward G. Joseph, Ferrysburg, MI (US)

(72) Inventor: Edward G. Joseph, Ferrysburg, MI (US)

(73) Assignee: JOE'S EATS, LLC, Lansing, MI (US)

( * ) Notice: Subject to any disclaimer, the term of this patent is extended or adjusted under 35 U.S.C. 154(b) by 157 days.

(21) Appl. No.: 16/690,360

(22) Filed: Nov. 21, 2019

(65) Prior Publication Data

US 2020/0087914 A1 Mar. 19, 2020

Related U.S. Application Data

(60) Division of application No. 15/630,700, filed on Jun. 22, 2017, now Pat. No. 10,487,505, which is a continuation of application No. 14/930,659, filed on Nov. 3, 2015, now Pat. No. 9,719,256, which is a continuation-in-part of application No. 13/403,196, filed on Feb. 23, 2012, now Pat. No. 9,180,604.

(60) Provisional application No. 61/464,012, filed on Feb. 25, 2011.

(51) Int. Cl.

| | |
|---|---|
| ***E04C 3/11*** | (2006.01) |
| ***E04C 3/17*** | (2006.01) |
| ***B27F 7/15*** | (2006.01) |

(52) U.S. Cl.

CPC ..... *E04C 3/11* (2013.01); *B27F 7/155* (2013.01); *E04C 3/17* (2013.01); *Y10T 29/49625* (2015.01); *Y10T 29/5397* (2015.01)

(58) Field of Classification Search

CPC ..... Y10S 269/91; Y10S 269/909; Y10T 29/5397; Y10T 29/53961; B23Q 3/102; B23Q 3/06; B23Q 5/38; B23Q 5/385; F16C 29/02; F16C 29/004; F16C 33/20; F16C 33/201

See application file for complete search history.

(56) References Cited

U.S. PATENT DOCUMENTS

| | | | |
|---|---|---|---|
| 1,580,426 | A | 4/1926 | Farnam |
| 1,820,667 | A | 8/1931 | Leyes |
| 2,430,613 | A | 11/1947 | Hodge |
| 2,707,419 | A | 5/1955 | Schron |
| 3,188,715 | A | 6/1965 | Michalsen |
| 3,554,530 | A | 1/1971 | Moore |
| 3,751,796 | A | 8/1973 | Wise |
| 3,959,945 | A | 6/1976 | Allen |
| 4,022,454 | A | 5/1977 | Bredvik |

(Continued)

*Primary Examiner* — Tyrone V Hall, Jr.

(74) *Attorney, Agent, or Firm* — Fitch, Even, Tabin & Flannery, LLP

(57) ABSTRACT

The disclosure generally relates to a locating assembly as a component of a locating table segment for positioning truss segments in a truss assembly system. The system generally includes a plurality of table segments aligned in parallel and adapted to position a series of locating blocks on a top surface of the system/table, where each block is a component of one of a plurality of locating assemblies in the system. The block positions collectively define an outer boundary of a support truss (e.g., as a roofing truss). Once the blocks are moved to their desired position, appropriately sized truss segments are placed within the block-defined boundary and fastened together.

5 Claims, 19 Drawing Sheets

(56) References Cited

U.S. PATENT DOCUMENTS 4,071,061 A 1/1978 Schneider
4,186,916 A 2/1980 Varga
4,530,493 A 7/1985 Break
4,622,730 A 11/1986 Steinbock
4,773,769 A 9/1988 Church
4,805,888 A 2/1989 Bishop
4,861,011 A 8/1989 Varga
4,943,038 A 7/1990 Harnden
5,085,414 A 2/1992 Weaver
5,255,489 A 10/1993 Matsumoto et al.
5,307,295 A 4/1994 Taylor et al.
5,342,030 A 8/1994 Taylor
5,429,438 A 7/1995 Wood
5,499,802 A 3/1996 Haberle
5,516,089 A 5/1996 Seniff
5,608,970 A 3/1997 Owen
5,702,095 A 12/1997 Williams
5,810,341 A 9/1998 Williams
5,837,014 A 11/1998 Williams
5,854,747 A * 12/1998 Fairlie ..... B25B 11/00 700/114
5,933,957 A 8/1999 Hasse
5,941,514 A 8/1999 Burcaw
5,947,460 A 9/1999 Williams
5,974,979 A 11/1999 Grady et al.
6,026,618 A 2/2000 Locke et al.
6,042,096 A 3/2000 MacLean
6,155,549 A 12/2000 Burcaw
6,158,487 A 12/2000 Licari
6,170,163 B1 1/2001 Bordignon
6,192,592 B1 2/2001 Zimmerman
6,244,010 B1 6/2001 Sluiter
6,267,365 B1 7/2001 Anglin
6,354,055 B1 3/2002 Shaw
6,702,269 B1 3/2004 Tadich
6,712,347 B1 3/2004 Fredrickson
6,899,324 B2 5/2005 Fredrickson
7,093,829 B2 8/2006 Fredrickson
7,140,100 B2 11/2006 Kanjee et al.
7,213,377 B1 5/2007 Sackett
2002/0046534 A1 4/2002 Heinly et al.
2002/0100226 A1 8/2002 Huppert
2002/0134040 A1 9/2002 Hew
2003/0179963 A1 9/2003 Hokkirigawa
2003/0182875 A1 10/2003 Hill
2004/0040255 A1 3/2004 Burness
2004/0118053 A1 6/2004 Huppert
2004/0119219 A1 6/2004 Hubbard
2004/0144055 A1 7/2004 Lewison
2005/0108986 A1 5/2005 Cloyd et al.
2005/0121844 A1 6/2005 Fredrickson
2005/0186062 A1 8/2005 Wall
2005/0204699 A1 9/2005 Rue
2007/0107333 A1 5/2007 Marsh et al.
2007/0133216 A1 6/2007 Wood
2007/0163201 A1 7/2007 Devlin
2007/0251770 A1 11/2007 Hargroder
2008/0179802 A1 7/2008 McAdoo et al.
2009/0071092 A1 3/2009 Vieira
2009/0145075 A1 6/2009 Oakley
2011/0132853 A1 6/2011 Drobot
2012/0273031 A1 11/2012 Sagayama

* cited by examiner

APPARATUS AND METHODS FOR TRUSS ASSEMBLY

CROSS-REFERENCE TO RELATED APPLICATIONS

This application is a divisional application of U.S. application Ser. No. 15/630,700, filed Jun. 22, 2017, which is a continuation of U.S. application Ser. No. 14/930,659, filed Nov. 3, 2015, which is a continuation-in-part of U.S. application Ser. No. 13/403,196, filed on Feb. 23, 2012, which claims the benefit of U.S. Provisional Patent Application No. 61/464,012, filed Feb. 25, 2011, the disclosures of which are incorporated herein by reference in their entirety.

BACKGROUND OF THE DISCLOSURE

1. Field of the Disclosure

The disclosure generally relates to apparatus, systems, and methods for assembling a building truss such as a roofing truss. A system including one or more locating table segments and one or more locating assemblies defining an assembly table with moveable locating assemblies or blocks is disclosed.

2. Brief Description of Related Technology

Tables and related systems with adjustable stops for assembling building trusses are known. Such systems often have one or more drawbacks, for example including excessively noisy operation and/or unreliable operation (e.g., resulting from the use of a conventional threaded rod drive system to position the stops at desired locations) as well as a susceptibility to interference and/or malfunctions from construction debris during normal operational use.

3. Objects

While the related art discloses truss assembly systems, there still exists a need for an improved truss assembly system along with its related components in order to provide quieter, more reliable operation under normal working conditions.

Therefore, it is an object of the present disclosure to provide an improved truss assembly system having improved operational characteristics. This and other objects will become increasingly apparent by reference to the following description.

SUMMARY

The disclosure relates to a locating assembly having (a) a mounting block having a top surface; (b) a guide assembly mounted to the top surface of the mounting block; (c) a locating block mounted to the guide assembly opposite the mounting block; and (d) an alignment guide mounted to the top surface of the mounting block a distance from the guide assembly. The guide assembly can have an I-shaped cross-section. A portion of the guide assembly may have a material having a low coefficient of static friction when in contact with steel. In one approach, at least a portion of the guide assembly comprises a material selected from the group consisting of poly(amides), poly(imides), poly(alkylenes), fluorinated poly(alkylenes), poly(vinyl aromatics), and poly (acetals). The locating block may have a circular cross-section.

In one embodiment the guide assembly can have (a) a first portion having a width; and (b) a second portion having a width less than the width of the first portion, wherein the first portion is closer to the top surface of the mounting block than the second portion. The guide assembly may optionally have a third portion located closer to the locating block than the first portion, and wherein the third portion has a width greater than the width of the second portion.

In another embodiment a locating table segment is provided having (a) a table segment; (b) a chain mounted beneath the table segment; (c) a locating assembly adjacent the table segment and connected to the chain, the locating assembly comprising: (i) a mounting block having a top surface, (ii) a guide assembly mounted to the top surface of the mounting block top, at least a portion of the guide assemble located adjacent to the table segment (iii) a locating block mounted to the guide assembly opposite the mounting block, the locating block positioned above the table segment, and (iv) an alignment guide mounted to the top surface of the mounting block a distance from the guide assembly, at least a portion of the alignment guide adjacent to the table segment. The locating table segment may further provide a motor configured to move the chain. According to one approach the guide assemble may have (a) a first portion having a width and positioned beneath the table segment; (b) a second portion having a width less than the width of the first portion; and (c) a third portion having a width greater than the width of the second portion and positioned above the table segment. In one embodiment, the first portion and the third portion may exert a compressive force on the table segment. Optionally, a second locating assembly adjacent the table segment and opposite the first locating assembly may be provided.

In another embodiment a truss assembly system is provided having (a) peripheral frame; (b) a plurality of beams spanning the frame; (c) at least one attachment bracket attached to each the plurality of beams; (d) a first table segment supported by at least one of the attachment brackets, the first table segment having a width; (e) a second table segment supported by at least one of the attachment brackets and positioned distance from the first table segment; (f) a chain mounted beneath the first table segment; (g) a locating assembly adjacent the first table segment and the second table segment, the locating assembly connected to the chain, and the locating assembly having (i) a mounting block having a top surface, (ii) a guide assembly mounted to the top surface of the mounting block top, at least a portion of the guide assemble located between the first table segment and second table segment, (iii) a locating block mounted to the guide assembly opposite the mounting block, the locating block positioned above at least one of the first table segment and second table segment, and (iv) an alignment guide mounted to the top surface of the mounting block a distance from the guide assembly, at least a portion of the alignment guide located between the first table segment and second table segment. The truss assembly system can also have a third table segment supported by at least one of the attachment brackets, the third locating table segment having a width half the width of the first table segment. The truss assembly system can optionally have a roller segment, the roller segment comprising a plurality of wheels. In this embodiment, a piston may be configured to raise at least a portion of the wheels of the roller segment above the plane of the first table segment and second table segment. The truss assembly can also have a motor configured to move the chain, and a controller to control the chain. In one approach, the truss assembly can have I-beams and wherein at least one of the attachment brackets has (a) a spacer connected to the I-beam; and (b) an L-bracket connected to the spacer opposite the beam, the L-bracket supporting at least one of the first table segment and second table segment.

Various refinements of the truss assembly system are possible. For example, an embodiment may comprise multiple table assemblies positioned adjacent or sufficiently close as to be operable as a single truss assembly system. Additionally, in an embodiment, the system comprises a plurality of first and second table segments positioned adjacent each other (e.g., where both are mono-locating table segments or where dual-locating table segments alternate with blank table segments), thereby defining a table surface comprising a plurality of slots each having an independently positionable locating assembly therein. The system can comprise a computer control system operatively connected to a plurality of movement means for independently selecting the longitudinal position of each locating assembly. In some embodiments the computer control system may control a motor configured to control a chain to which a locating assembly is connected.

All patents, patent applications, government publications, government regulations, and literature references cited in this specification are hereby incorporated herein by reference in their entirety. In case of conflict, the present description, including definitions, will control.

Additional features of the disclosure may become apparent to those skilled in the art from a review of the following detailed description, taken in conjunction with the examples, drawings, and appended claims, with the understanding that the disclosure is intended to be illustrative, and is not intended to limit the claims to the specific embodiments described and illustrated herein.

BRIEF DESCRIPTION OF THE DRAWINGS

For a more complete understanding of the disclosure, reference should be made to the following detailed description and accompanying drawings wherein.

Figure 1:
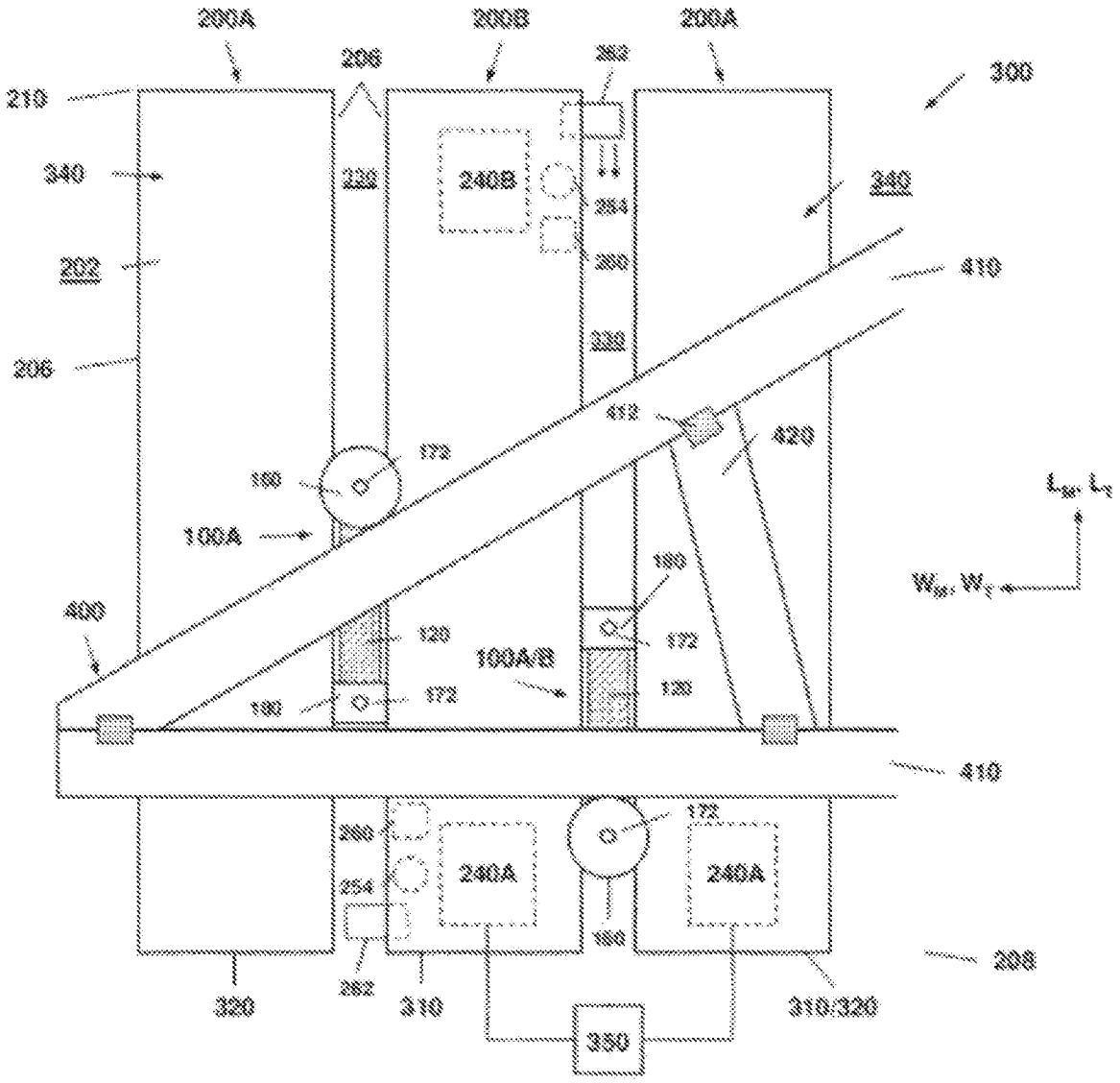
FIG. 1 is a top view of a truss assembly system including a locating assembly and a locating table segment according to the disclosure.
Figure 2:
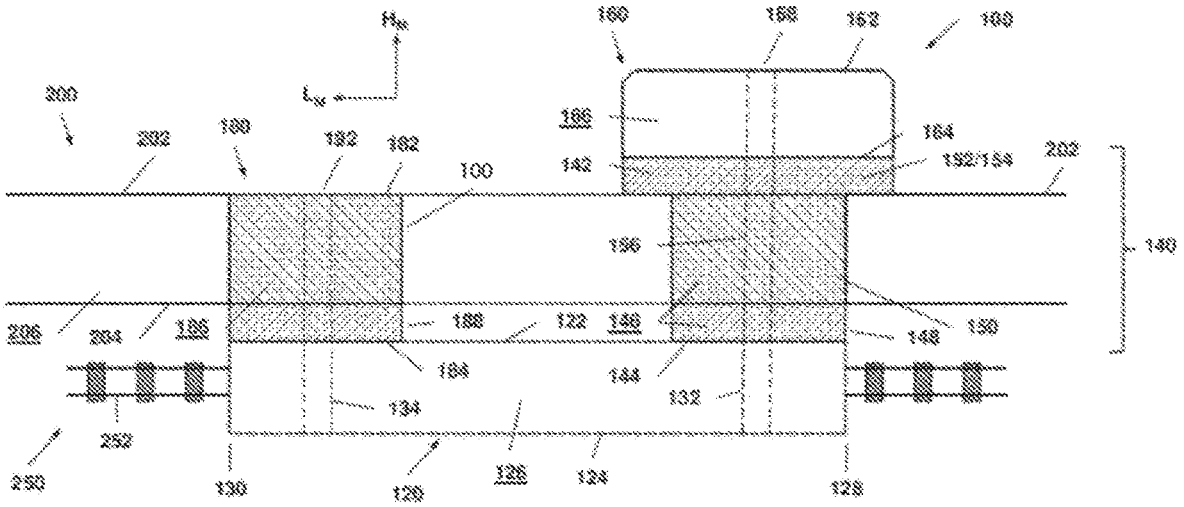
FIG. 2 is a side view of a locating assembly according to the disclosure.
Figure 3:
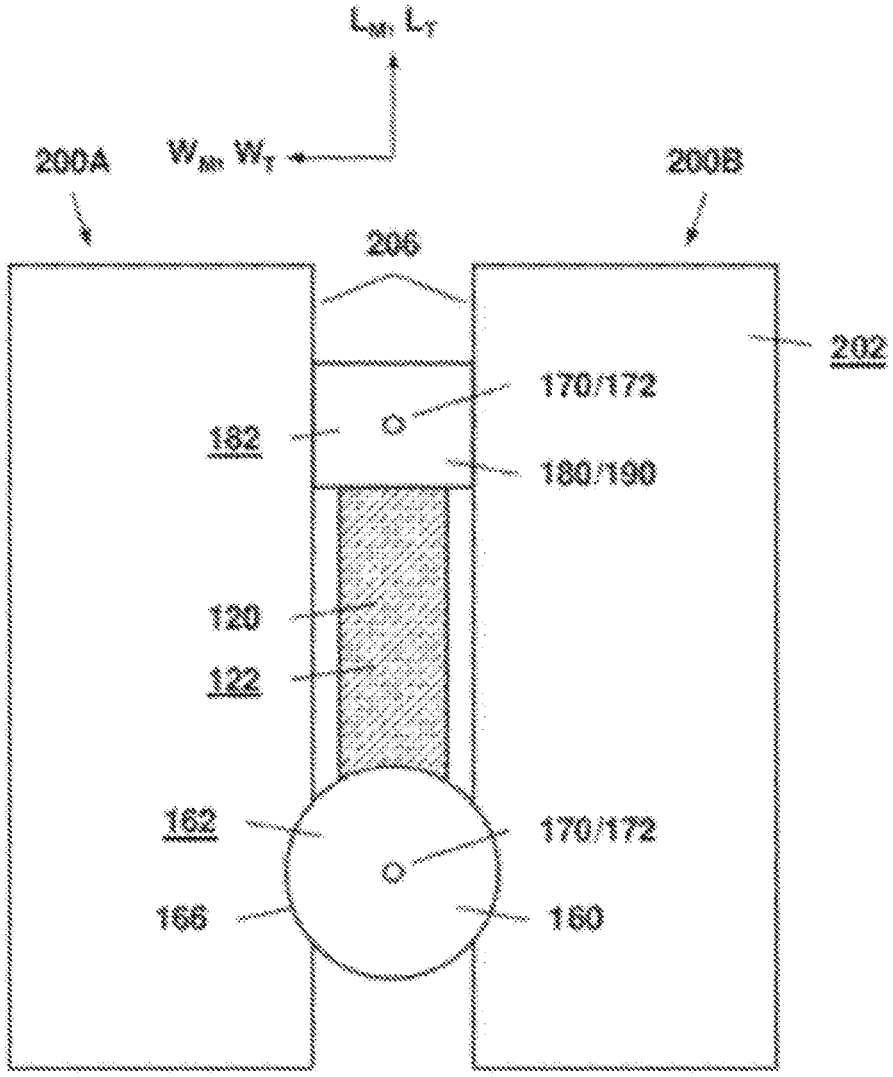
FIG. 3 is a top view of the locating assembly in FIG. 2.

While the disclosed apparatus and methods are susceptible of embodiments in various forms, specific embodiments of the disclosure are illustrated in the drawings (and will hereafter be described) with the understanding that the disclosure is intended to be illustrative, and is not intended to limit the claims to the specific embodiments described and illustrated herein.

DETAILED DESCRIPTION

With reference to FIGS. 1-21, the present disclosure generally relates to a table 900 assembly having a locating assembly 100 as a component of a locating table segment 310 for positioning truss segments 410 in a truss assembly system 300. The system 300 generally includes a plurality of table segments 200 aligned in parallel and adapted to position a series of locating blocks 160 on a top surface of the table 900, where each block 160 is a component of one of a plurality of locating assemblies 100 in the system 300. The system may further include multiple table assemblies 900 positioned adjacent or sufficiently close as to be operable as a single truss assembly system. The block 160 positions collectively define an outer boundary of a support truss 400 (e.g., as a roofing truss). Once the blocks 160 are moved to their desired positions, appropriately sized truss segments 410 (e.g., wooden boards) are placed within the block-defined boundary and fastened together (e.g., via screws, nails, or any other fastening means 412; with or without internal webbing truss support segments 420).

The apparatus of the present disclosure have several advantages over related automated truss jig setting systems. The locating assembly 100 includes at least one guide that ensures the positional stability of the locating block 160 (i.e., in terms of its relative position in all three coordinate directions) as the locating assembly 100 is moved along the length of its table segment 200/310. Suitably, the guide portions of the locating assembly 100 are formed from low-friction materials that both (i) reduce noise associated with the movement of the locating assembly 100 and (ii) reduce the power needed to drive the locating assembly 100 during use. In some embodiments, the locating assembly 100 is incorporated into the locating table segment 310/truss assembly system 300 with an endless chain 252 and driven sprocket 254/276 that move the locating assembly 100 in both longitudinal directions along the table segment 200. The chain-and-sprocket assembly provides a reliable means to repeatably position a given locating assembly 100 at any precisely selected longitudinal position with very little noise. Additionally, the construction of the locating assembly 100 and its incorporation into the locating table segment 310 limit the ability of construction debris to fall below the table surface or otherwise interfere with the operation/movement of the locating assembly 100.

As used herein, the term "mounted" can represent a direct mounting between two structural units, where the indicated parts/units are in direct contact with each other. Alternatively or additionally, the term can represent an indirect mounting between two structural units, where the indicated parts/units are connected via an intervening structure. Generally, the relative positions of two units mounted together are at least partially if not completely constrained (e.g., two parts mounted together may be fixed in position relative to each other, or they may be mounted in a way to permit rotational or translational motion relative to each other).

As used herein, the terms "above," "below," "top," and "bottom" are relative spatial indicators for the indicated structural elements. The terms "above" and "top" can be used to represent relative spatial positioning in a relevant height direction for a first element having a height coordinate higher than that of a second element denoted with the term "below" or "bottom."

Table Assembly

Figure 9:
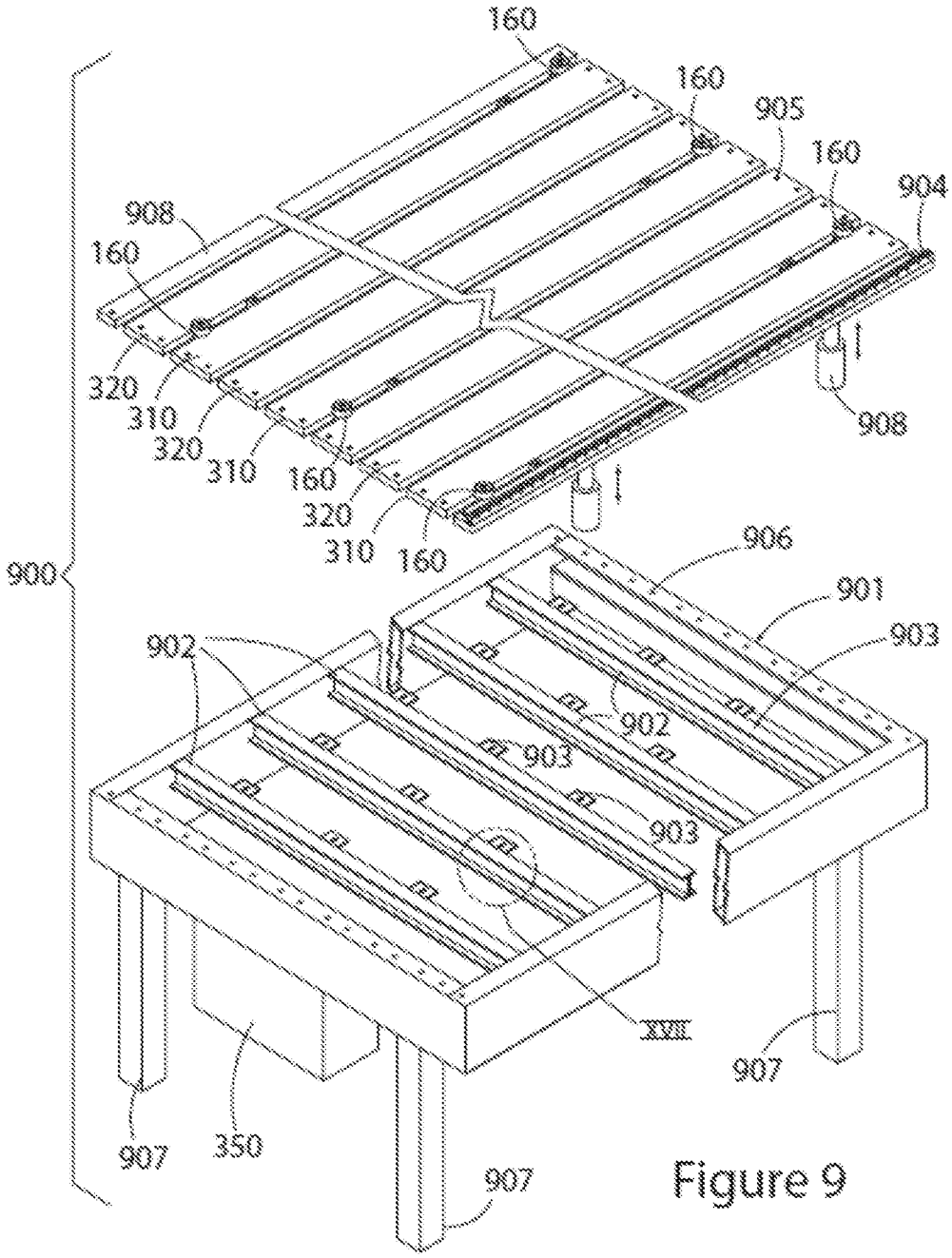
FIG. 9 is an exploded top perspective view of one possible embodiment of a table assembly according to the disclosure.
Figures 10, 11, 12, 13:
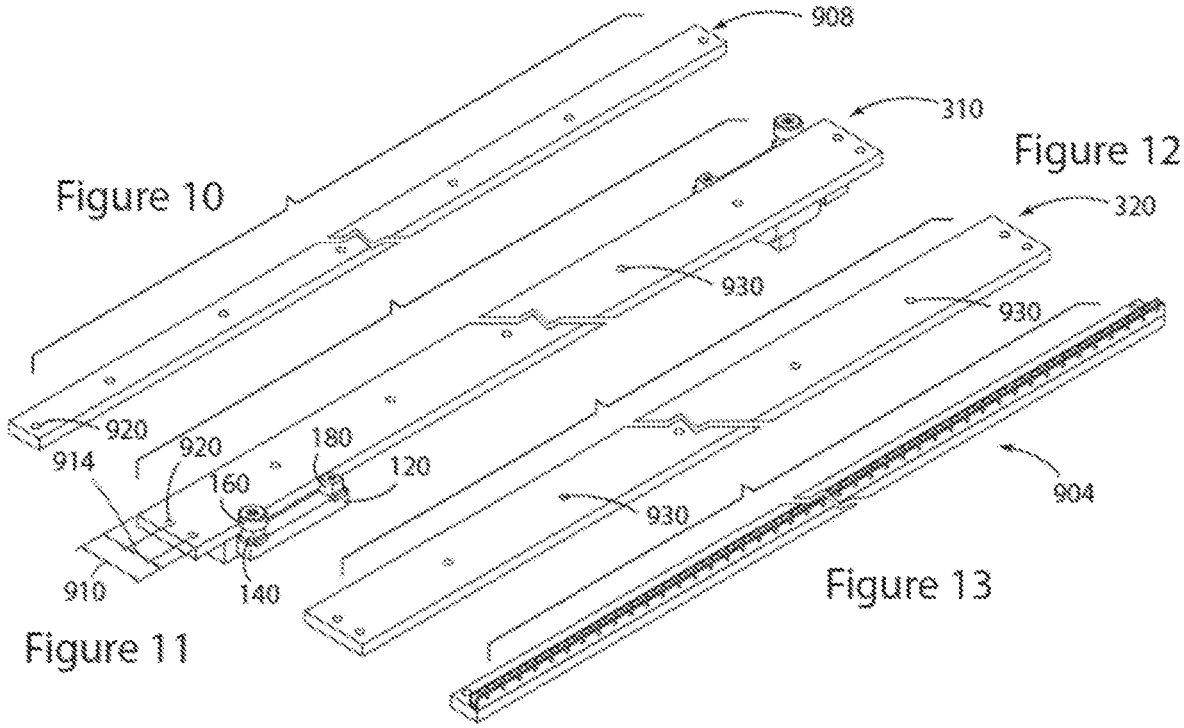
FIG. 10 is a top perspective view of a partial width table segment.
FIG. 11 is a top perspective view of a locating table segment.
FIG. 12 is a top perspective view of a blank table segment.
FIG. 13 is a top perspective view of a roller segment.

FIG. 9 illustrates a possible embodiment of a table assembly according to the disclosure and generally indicated at 900. The embodiment of the table shown in FIG. 9 generally includes a spanning frame (frame) 901. In the depicted embodiment 900 spanning frame 901 has a rectangular shape, however, other possible configurations, such as triangular, square, polygonal, are equally possible and within the scope of this disclosure. Spanning frame 901 are a plurality of beams 902. While beams 902 are I-beams in the depicted embodiment, beams of other configurations may be utilized. Additionally, though beams 902 are shown spanning frame 901 in the width direction, in combination or the alternative, beams 902 may span frame 901 in the longitudinal direction. A plurality of attachment brackets 903 are secured to the plurality of beams 902. Attachment brackets 903 support/blank table segments 320 (also labeled as table segment 200 in some figures) and locating table segments 310. Blank table segments 320 and locating table segments 310 may be secured to frame 901 of the table assembly 900 by various means including, but not limited to, screws, pins, bolts, clamps, welds and/or adhesives. In the embodiment depicted in FIG. 9, blank table segments 320 and locating table segments 310 are secured to frame 901 by pins and/or bolts passing through mounting holes 905 passing through the ends of locating table segments 310 and blank table segments 320 and into mounting holes 906 within frame 901. As also shown in FIG. 9, in some embodiments a half-width table segment 908 may be included to facilitate assembly of a truss on adjacent table assemblies 900.

The blank table segments 320 and locating table segments 310 may be formed in a variety width and lengths based on the intended application. For example, in some embodiments the blank table segments 320 may have a width of 8 inches and the half-width table segments 908 may have a width between 1 inch to 2.5 inches. The length of the blank table segments 320, half-width table segments 908, and locating table segments 310 can vary based on the intended application but generally can be between 168 inches to 192 inches.

In the embodiment shown in FIG. 9, frame 901 is supported of the ground by a set of legs 907. In other embodiments, frame 901 may rest upon the ground.

Blank table segments 320 and locating table segments 310 collective form a table surface upon which a truss may be assembled. Above the surface formed by blank table segments 320 and locating table segments 310 are locating blocks 160 of locating assemblies supported by locating table segments 310. As to facilitate the removal of a truss assembled upon table assembly 900, a roller segment 904 comprising a plurality of wheels may be included. When assembly of the truss is completed, roller segment 904 and the assembled truss may be lifted by piston 908 as to permit the assembled truss to slide off of table assembly 900.

Locating Assembly

FIGS. 2-7 illustrate the locating assembly 100 in various embodiments according to the disclosure. The locating assembly 100 generally includes a mounting block 120 (e.g., for mounting of the assembly 100 to a movement means 240 of a locating table segment 310/truss positioning system 300), a guide assembly 140 mounted to the top of the mounting block 120, and (optionally) a locating block 160 mounted to the top of the guide assembly 140.

The illustrated mounting block 120 includes a top surface 122, an opposing bottom surface 124, and opposing side surfaces 126 extending between a proximal end 128 and a distal end 130 of the block 120. The structure of the block 120 generally defines a longitudinal direction L.sub.M, which is the direction of extent between the proximal and distal ends 128, 130. The longitudinal direction L.sub.M can be defined, for example, as the centerline/length axis of the block 120 and/or the direction of travel of the block 120/locating assembly 100 during use in the locating table segment 310. Similarly, the block 120 also defines a width direction W.sub.M that is perpendicular to the longitudinal direction L.sub.M and generally corresponds to the direction of extent between the side surfaces 126. The block 120 further defines a height direction H.sub.M that is perpendicular to both the longitudinal direction L.sub.M and the width direction W.sub.M and generally corresponds to the direction of extent between the top and bottom surfaces 122, 124.

As illustrated, the mounting block 120 can have an elongate shape extending in the longitudinal direction L.sub.M (e.g., generally straight) and a rectangular cross section in the width W.sub.M and height H.sub.M directions. The block 120 suitably has a flat top surface 122 to facilitate the mounting of other components thereupon, but any shape is possible for the top 122 and other surfaces of the block 120. The block 120 (as well as other apparatus and system components) is generally suitably sized for a truss assembly operation, in which case the width and height of the block 120 can be at least 0.5 cm, 1 cm, or 2 cm and/or up to 2 cm, 5 cm, or 10 cm, and the length of the block 120 can be at least 1 cm, 2 cm or 5 cm and/or up to 5 cm, 10 cm, 20 cm or 50 cm. As further shown, the block 120 can include a first receiving hole 132 at/near its proximal end 128 for mounting a guide assembly 140 (described below) and a second receiving hole 134 at/near its distal end 130 for mounting an alignment guide 180 (also described below), where the holes 132, 134 can extend partially or completely through the block 120 in the height direction H.sub.M.

The mounting block 120 can be formed from any suitable rigid, resilient material such as a metal material (e.g., having a steel construction) or a rigid plastic material.

The illustrated guide assembly 140 includes a top surface 142, an opposing bottom surface 144 (e.g., opposing in the height direction H.sub.M), and opposing side surfaces 146 (e.g., opposing in the width direction W.sub.M). The bottom surface 144 of the guide assembly 140 is mounted to the top surface 122 of the mounting block 120 (e.g., via a receiving hole 156 extending therethrough that is complementary to the first receiving hole 132 of the block 120) so that the guide assembly 140 extends upwardly in the height direction H.sub.M relative to the block 120 (e.g., away therefrom). The guide assembly 140 includes at least three portions, which can form a single integral structure for the guide assembly 140, but which suitably include two or more separate structures that are mounted together to form a composite guide assembly 140 structure that is incorporated into the locating assembly 100. More specifically, the guide assembly 140 includes (i) a first portion 148 having a first width W.sub.1, (ii) a second portion 150 having a second width W.sub.2, and (iii) a third portion 152 having a third width W.sub.3. As shown, the first, second, and third portions 148, 150, and 152 are oriented at successively further height positions away from the mounting block 120 (e.g., the first portion 148 is located closer in the height direction H.sub.M to the mounting block 120 top surface 120 than the second portion 150 and the third portion 152, and the second portion 150 is located intermediate the first portion 148 and the third portion 152 in the height direction H.sub.M). The various width, height, length, and diameter (when applicable) values of the guide assembly 140 and/or its component portions can be at least 0.2 cm, 0.5 cm, 1 cm, or 2 cm and/or up to 1 cm, 2 cm, 5 cm, or 10 cm.

The guide assembly 140 provides a means to stabilize the vertical position of the locating assembly 100 relative to adjacent table segments 200 when integrated into a locating table segment 310 or truss positioning system 300. In particular, the first width W.sub.1 and the third width W.sub.3 can be greater than the second width W.sub.2 (e.g., where the first width W.sub.1 and the third width W.sub.3 can be the same or different), thereby defining two receiving portions 158 for table segment 200 sides/edges at opposing side surfaces 146 of the guide assembly 140 (e.g., in which case table segment 200 sides/edges in the receiving portions are constrained against vertical motion in either direction). The portions of the guide assembly 140 are illustrated as having constant/uniform widths (or diameters, in the case of cylindrical components). However, the portions can have non-uniform widths (e.g., widths varying as a function of the height direction H.sub.M). In such cases, the guide assembly 140 can be shaped such that the first width W.sub.1 at a selected height position in the first portion 148 and the third width W.sub.3 at a selected height position in the third portion 152 are greater than the second width W.sub.2 at a selected height position in the second portion 150 (e.g., at least some parts of the first and third portions are wider than at least some part of the second portion).

As generally shown in the figures, the guide assembly 140 can have an I-shaped cross-section in the width direction W.sub.M and the height direction H.sub.M. Such a shape conveniently defines rectangular receiving portions 158 complementary to a rectangularly shaped table segment 200. The first and second portions 148, 150 suitably have a constant cross sectional shape extending in the longitudinal direction L.sub.M. This can provide a means to stabilize the vertical position of the locating assembly 100 relative to adjacent table segments 200 when integrated into a locating table segment 310 or truss positioning system 300 insofar as the side surfaces 146 of the second portion 150 are generally adjacent to and/or in contact with neighboring edges/sides 206 of adjacent table segments 200. In an embodiment, the third portion 152 of the guide assembly 140 has a circular cross section in the width direction W.sub.M and the longitudinal direction L.sub.M (e.g., perpendicular to the height direction H.sub.M), with the diameter of the circular cross section corresponding to the third width W.sub.3. In other embodiments, the third portion 152 can more generally have any other curved, non-straight edges that facilitate the positioning of a straight/flat truss segment 410 edge at a variety of different angles relative to the third portion 152.

Figure 5A:
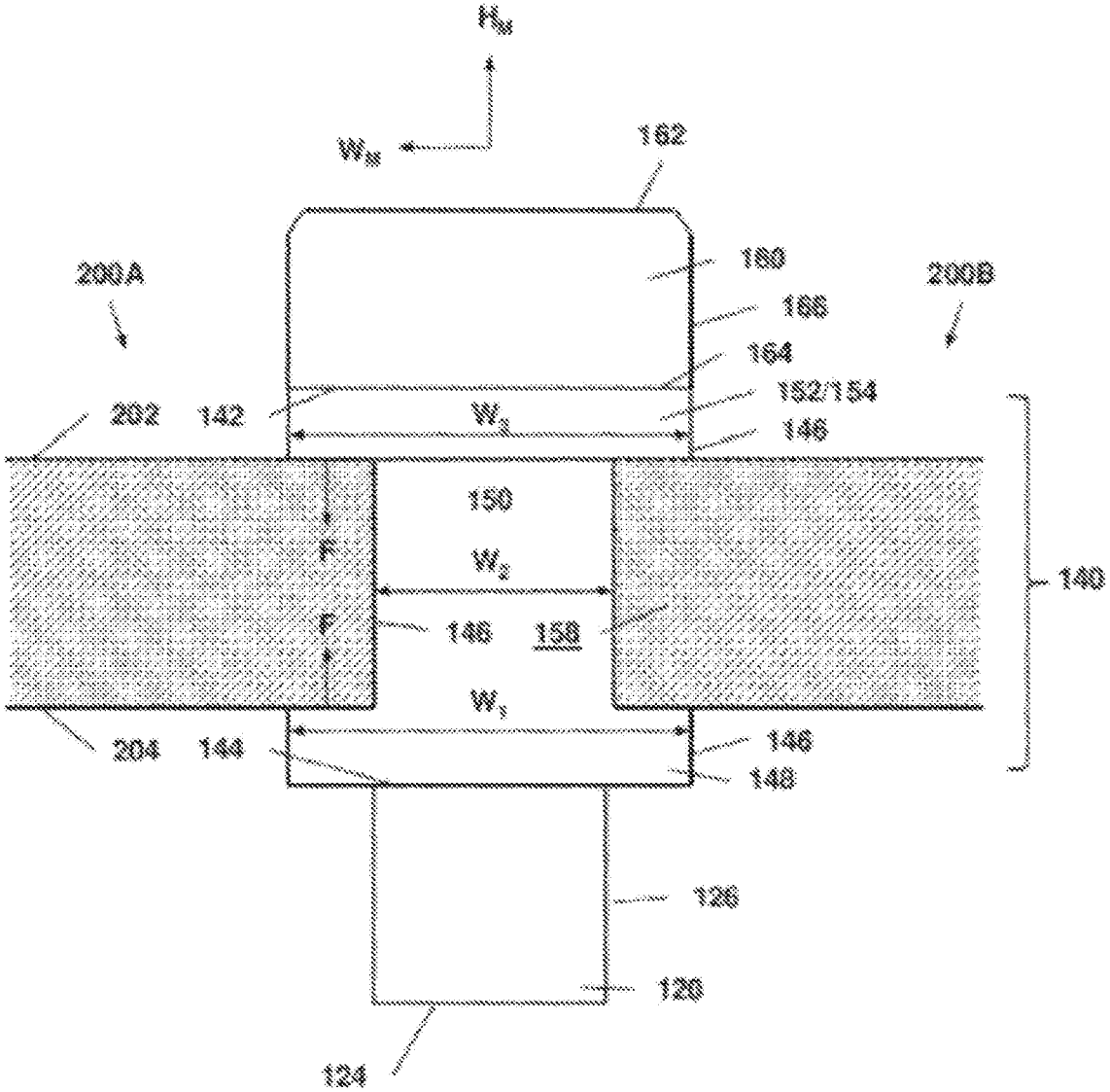
FIGS. 5A-5E are front views of a locating block and guide assembly according to various embodiments of the disclosure.
Figure 5B:
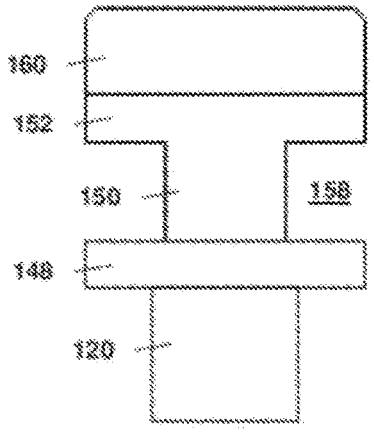
Figure 5C:
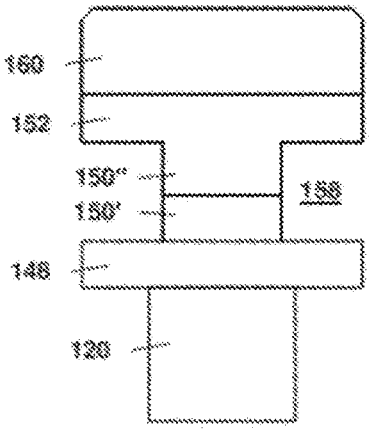
Figure 5D:
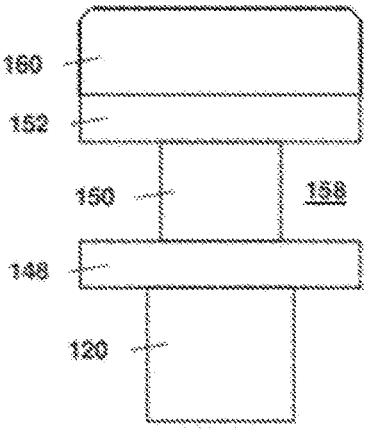

FIGS. 5A-5E illustrate various embodiments in which the guide assembly 140 includes two separate structural elements or portions combined or mounted together in a composite assembly 140 structure (e.g., with a composite I-shaped cross-section as described above). FIG. 5A illustrates an embodiment in which (i) the first portion 148 and the second portion 150 are integrally formed (e.g., in a T-shaped rectangular block having a T-shaped cross section in the width direction W.sub.M and the height direction H.sub.M, and extending in the longitudinal direction L.sub.M), and (ii) the third portion 152 is a separate structure from the first portion 148 and the second portion 150 (e.g., having a cylindrical shape, such as a disc-shaped spacer/washer 154). FIG. 5B illustrates an embodiment in which (i) the second portion 150 and the third portion 152 are integrally formed (e.g., a block having an inverted T-shaped cross section in the width direction W.sub.M and the height direction H.sub.M, and extending in the longitudinal direction L.sub.M, where the third portion 152 can have a cylindrical shape as above the second portion 150 can have a rectangular block shape), and (ii) the first portion 148 is a separate structure from the second portion 150 and the third portion 152 (e.g., having a generally flat, rectangular plate shape). FIG. 5C illustrates an embodiment in which (i) the first portion 148 and a part of the second portion 150' are integrally formed, and (ii) the third portion 152 and a remaining part of the second portion 150" are integrally formed (e.g., shapes with two complementary T-shaped cross sections to form a composite I-shaped cross section, such as a cylindrical shape (third portion 152) and rectangular block shapes (first and second portions 148, 150)). FIG. 5D illustrates an embodiment in which the first portion 148, the second portion 150, and the third portion 152 are separately formed (e.g., each having the rectangular or cylindrical shapes as above).

The guide assembly 140 (e.g., whether integrally formed or including separate structural components) is suitably formed from a low-friction material (i) to reduce the force required to traverse the locating assembly 100 along the length of a table segment 200, (ii) to reduce the wear on other (e.g., metal or steel) components of the locating table segment 310/truss positioning system 300, and (iii) to reduce the noise generated by the locating assembly 100 in use. Such materials can be characterized as having a low coefficient of friction (e.g., static or dynamic), for example when in contact with other like materials or with a metal (e.g., steel, which is a common material for other system 300 components). Suitable values for the coefficient of friction can include values less than that of a comparable steel-steel system (e.g., about 0.7-0.8 (static) or about 0.4-0.7 (dynamic)), for example not more than 0.6, 0.4, 0.2, 0.1, 0.07, or 0.05, and/or at least 0.01, 0.02, 0.04, 0.06, 0.08, or 0.1 (e.g., where such values can represent static or dynamic friction coefficients) with dynamic friction coefficients generally being equal to or less than their static counterparts. Suitable low-friction materials can include various plastic or polymeric materials such as poly(amides) (e.g., aliphatic polyamides including nylons such as nylon 6, nylon 6,6), poly(imides), poly(alkylenes) (e.g., polyethylene, polypropylene), fluorinated poly(alkylenes) (e.g., perfluorinated poly(alkylenes) such as poly(tetrafluoroethylene), polyvinyl aromatics) (e.g., polystyrene), poly(acetals) (e.g., polyoxymethylene). Copolymers including one or monomers of the foregoing polymers (e.g., along with an additional monomer, whether or not in the foregoing list) also can be used. Similarly, mixtures of various low-friction polymeric materials can be used. In some embodiments, the low-friction material can further include one or more filler components, for example those that further reduce the frictional coefficient of the material such as a solid lubricant like graphite and/or molybdenum disulfide.

The locating assembly 100 can further include a locating block 160. The block 160 includes a top surface 162, an opposing bottom surface 164 (e.g., opposing in the height direction H.sub.M), and a side surface 166. The bottom surface 164 of the block 160 is mounted to the top surface 142 of the guide assembly 140. In some embodiments block 160 may be mounted to the top surface 142 of the guide assembly 140 via a receiving hole 168 extending therethrough that is complementary to the receiving hole 156 of the guide assembly 140 and the first receiving hole 132 of the block 120, so that the block 160 extends upwardly in the height direction H.sub.M relative to the block 120 and the guide assembly 140 (e.g., away therefrom). Embodiments are also possible in which block 160 is mounted to the top surface 142 of the guide assembly 140 by being made integral with the third portion 152 of guide assembly 140. In further embodiments, block 160 may be made integral with the third portion 152 of guide assembly 140 and the third portion 152 may be made integral with the second portion 150 of guide assembly 140. Regardless of whether mounting block 160 and guide assembly 140 are separate or integral, the width W.sub.2 of the second portion 150 of guide assembly 140 may be smaller than the width of the slot 330 defined by adjacent table segments 200. For instance, the second portion 150 of guide assembly 140 may be sufficiently sized as to provide one-sixty-seconds of inch clearance on either side of the second portion 150.

Figure 5E:
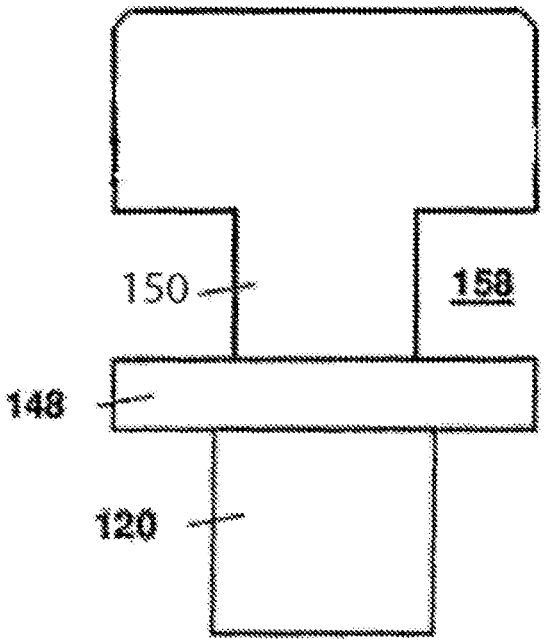

FIG. 5E illustrates an embodiment in which the first portion 148 and the second portion 150 are separately formed (e.g., each having the rectangular or cylindrical shapes as above). It is noted that FIG. 5E is for illustrative purposes only and that several other variations of extending locating block 160 into slot 330 are possible. It is also noted that the diameter of locating block 160 (and even second portion 150) disposed with slot 330 are narrower than the width of slot 330. Preferably, this leads to about 40/1,000 of an inch in clearance. Providing locating block 160 that extends into slot 330 allows for easier retooling and replacement as single piece.

Similar to the third portion 152, the block 160 can have a generally cylindrical shape with a circular cross section in the width direction W.sub.M and the longitudinal direction L.sub.M (e.g., perpendicular to the height direction H.sub.M), with the diameter of the circular cross section suitably being at least as large as the third width W.sub.3 (or the equivalent diameter for a circular third portion 152 and generally larger than the width of a slot 330 defined by adjacent table segments 200). Similar to the third portion 152, the block 160 can more generally have any other curved, non-straight edges that facilitate the positioning of a straight/flat truss segment 410 edge at a variety of different angles relative to the side surface 166 of the block 160. Similar to the mounting block 120, the locating block 160 can be formed from any suitable rigid, resilient material such as a metal material (e.g., having a steel construction) or a rigid plastic material. In an embodiment, the block 160 can be omitted, in which case the third portion 152 suitably can be extended in the height direction H.sub.M so that the third portion 152 can serve as both the locating block and the upper portion of the guide assembly 140. The various width, height, length, and diameter (when applicable) values of the locating block 160 can be at least 0.5 cm, 1 cm, or 2 cm and/or up to 2 cm, 5 cm, or 10 cm.

The locating assembly 100 can include (i) a fastening means for fastening the mounting block 120, the guide assembly 140 (e.g., including components thereof), and the locating block 160 (when present) together, and (ii) a compression means for exerting a compression force F in the height direction H.sub.M between the first portion 148 and the third portion 152 of the guide assembly 140 (e.g., illustrated as two opposing compression forces F in FIG. 5A). The fastening means and the compression means can be collectively represented as element 170, for example as a bolt or rod 172 (e.g., metal, steel) extending in the height direction H.sub.M through the mounting block 120, the guide assembly 140, and the locating block 160. The bolt or rod 172 can be threaded and extend through complementary receiving holes 132, 156, 168 in the fastened components, such as where the mounting block 120 has a threaded cylindrical receiving hole 132 to receive the threaded distal end of the bolt 172, where tightening of the bolt 172 at its proximal end (e.g., at the locating block 160) fastens the components together and induces the compression force F.

The locating assembly 100 can include an alignment guide 180, for example when the mounting block 120 extends in the longitudinal direction L.sub.M and provides additional mounting area for the guide 180 (e.g., which is separate and spaced apart from the guide assembly 140). The alignment guide 180 and guide assembly 140 are similar in structure, size, and construction (e.g., formed from similar low-friction materials). The illustrated alignment guide 180 includes a top surface 182, an opposing bottom surface 184 (e.g., opposing in the height direction H.sub.M), and opposing side surfaces 186 (e.g., opposing in the width direction W.sub.M). The bottom surface 184 of alignment guide 180 is mounted to the top surface 122 of the mounting block 120 (e.g., via a receiving hole 192 extending therethrough that is complementary to the second receiving hole 134 of the block 120) so that the alignment guide 180 extends upwardly in the height direction H.sub.M relative to the block 120 (e.g., away therefrom). Analogous to the guide assembly 140, the alignment guide 180 can include two or more portions, which can form a single integral structure for the alignment guide 180. More specifically, the alignment guide 180 includes (i) a first portion 188 having a first width W.sub.1 and (ii) a second portion 190 having a second width W.sub.2. As shown, the first and second portions 188, 190 are oriented at successively further height positions away from the mounting block 120 (e.g., the first portion 188 is located closer in the height direction H.sub.M to the mounting block 120 top surface 120 than the second portion 190).

The alignment guide 180 can partially stabilize the vertical position of the locating assembly 100 relative to adjacent table segments 200 when integrated into a locating table segment 310 or truss positioning system 300. In an embodiment, the first width W.sub.1 can be greater than the second width W.sub.2, thereby defining two extending lip or flange portions at opposing side surfaces 186 of the alignment guide 180 (e.g., in which case the lip or flange portions against table segment 200 sides/edges constrain the locating assembly 100 against upward vertical motion). Various suitable shapes for the first and second portions 188, 190 alignment guide 180 are analogous to the first and second portions 148, 150 of the guide assembly 140, as described above. In an embodiment, the height of the alignment guide 180 is the same or less than the height of the corresponding first and second portions 148, 150 of the guide assembly 140 such that the top surface 182 of the alignment guide 180 generally lies at or below the top surface 202 (or table surface) in an assembled apparatus. In another embodiment, alignment guide 180 can be shaped without any particular constraint on the first width W.sub.1 and the second width W.sub.2, such as when the two widths are the same and the alignment guide 180 can have a simple rectangular block structure. Further similar to the guide assembly 140, the first and second portions 188, 190 suitably have a constant cross sectional shape extending in the longitudinal direction L.sub.M. This can provide a further means to stabilize the horizontal position of the locating assembly 100 relative to adjacent table segments 200 when integrated into a locating table segment 310 or truss positioning system 300 insofar as the side surfaces 186 of the second portion 190 are generally adjacent to and/or in contact with neighboring edges/sides 206 of adjacent table segments 200.

As generally shown in the figures, the mounting block 120 and the guide assembly 140 are separately formed structures. This permits the mounting block 120 to be formed from a strong, durable material like steel, while the guide assembly 140 can be formed from a low-friction material like any of the various indicated polymers. In another embodiment, the mounting block 120 and at least a portion of the guide assembly 140 can form an integral structure (e.g., the mounting block 120 and a lower (e.g., the first) portion of the guide assembly 140 can be integrally formed as a low-friction component block).

Locating Table Segment

FIGS. 1, 7, 8 and 11 illustrate the locating table segment 310 in various embodiments according to the disclosure. The locating table segment 310 generally includes a table segment 200, the locating assembly 100 in any of its various embodiments positioned adjacent to the table segment, and a movement means 240 mounted to the locating assembly 100.

The illustrated table segment 200 includes a top surface 202, an opposing bottom surface 204, and opposing side surfaces 206 extending between a proximal end 208 and a distal end 210 of the table segment 200. The structure of the table segment 200 generally defines a longitudinal direction L.sub.T, which is the direction of extent between the proximal and distal ends 208, 210. The longitudinal direction L.sub.T can be defined, for example, as the centerline/length axis of the table segment 200 and/or the direction of travel of the block 120/locating assembly 100 during use in the locating table segment 310. Additionally, longitudinal direction L.sub.T can correspond to the direction of the longest length dimension of the table segment 200 or an edge/side 206 adjacent the locating assembly (e.g., when opposing sides of the table segment 200 are not necessarily parallel and/or the table segment 200 does not have a rectangular geometry). Similarly, the table segment 200 also defines a width direction W.sub.T that is perpendicular to the longitudinal direction L.sub.T and generally corresponds to the direction of extent between the side surfaces 206. The table segment 200 further defines a height direction H.sub.T that is perpendicular to both the longitudinal direction L.sub.T and the width direction W.sub.T and generally corresponds to the direction of extent between the top and bottom surfaces 202, 204.

As illustrated, the table segment 200 can have an elongate shape extending in the longitudinal direction L.sub.T (e.g., generally straight) and further can have a rectangular cross section in the width W.sub.T and height H.sub.T directions. The length of table segment 200 can be at least 1 m, 2 m, or 3 cm and/or up to 6 m, 8 m, or 10 m. The height of table segment 200 can be at least 0.5 cm, 1 cm, or 2 cm and/or up to 2 cm, 5 cm, or 10 cm. The width of table segment 200 can be at least 2 cm, 5 cm, 10 cm, or 15 cm and/or up to 20 cm, 25 cm, 30 cm, 40 cm, or 50 cm. The table segment 200 suitably has a flat top surface 202 to facilitate the placement of truss segments 410 of a flat table surface defined by the collective top surfaces 202, but any desired shape may be for the other surfaces of the table segment. For example, the side surfaces 206 are illustrated as being generally vertical or perpendicular to the top surface 202, but either or both of the side surfaces 206 may angled (i.e., not perpendicular) relative to the top surface 202 such that a cross section between the side surfaces 206 of adjacent table segments 200 (e.g., the slot 330) can have a non-rectangular shape (e.g., a generally trapezoidal shape that expands upwardly or downwardly).

Similar to the mounting block 120, the table segment 200 can be formed from any suitable rigid, resilient material such as a metal material (e.g., having a steel construction) or a rigid plastic material.

The locating table segment 310 includes the locating assembly 100 (according to any of its various embodiments) positioned adjacent the side surface 206 of the table segment 200 (e.g., extending away from the side surface 206 in the width direction W.sub.T). The locating assembly 100 is positioned such that the longitudinal direction L.sub.M of the mounting block 120 and the longitudinal direction L.sub.T of the table segment 200 are substantially parallel (e.g., parallel or parallel to within a machining tolerance such as not more 1.degree., 0.5.degree., 0.2.degree., or 0.1.degree.). In the assembled locating table segment 310, a portion of a table segment 200 side/edge is located within either or both of the two receiving portions 158 defined by the guide assembly 140.

More specifically, the first portion 148 of the guide assembly 140 is below the table segment 200 bottom surface 204, for example where a segment such as a lip or flange section of the first portion 148 extends below the table segment 200 and can be in contact with or next to the bottom surface 204, with or without any intervening structure. Similarly, the third portion 152 of the guide assembly 140 is above the table segment 200 top surface 202, for example where a segment such as a lip or flange section of the third portion 152 extends above the table segment 200 and can be in contact with or next to the top surface 202, with or without any intervening structure. The second portion 150 of the guide assembly 140 is adjacent the table segment 200 side surface 206, for example where all or some the side surface 146 of the guide assembly second portion 150 is in contact with or next to the side surface 206, with or without any intervening structure. Accordingly, as illustrated, the mounting block 120 is below both the table segment 200 bottom surface 204 and the first portion 148 of the guide assembly 140, and the locating block 160 is located above the table segment 200 top surface 202 and the third portion 152 of the guide assembly 140.

As shown, the first portion 148 and the third portion 152 of the guide assembly 140 maintain the locating assembly 100 in a fixed position in the height direction H.sub.M (or H.sub.T as all three coordinate directions are generally parallel or substantially parallel in many embodiments) relative to the table segment 200. In particular, the first portion 148 and the third portion 152 exert a compressive force F between the top surface 202 and the bottom surface 204 of the table segment 200 (e.g., on the edge portion of the top and bottom surfaces 202, 204 near the side surface 206) such as when the compression/fastening means 170 drives/pushes the first portion 148 upward and the third portion 152 downward in the height direction H.sub.M.

Movement means generally includes a longitudinal translation means 250 for moving the locating assembly 100 in the longitudinal direction L.sub.M or L.sub.T. The longitudinal translation means 250 is mounted to the bottom surface 204 of locating table segment 310 and generally extends between the proximal and distal ends 208, 210 of locating table segment 310. The movement means may generally further include a driver means 270 operatively coupled to the longitudinal translation means 250, where the driver means moves the longitudinal translation means 250 and the locating assembly 100 in the longitudinal direction L.sub.M or L.sub.T.

Figure 4:
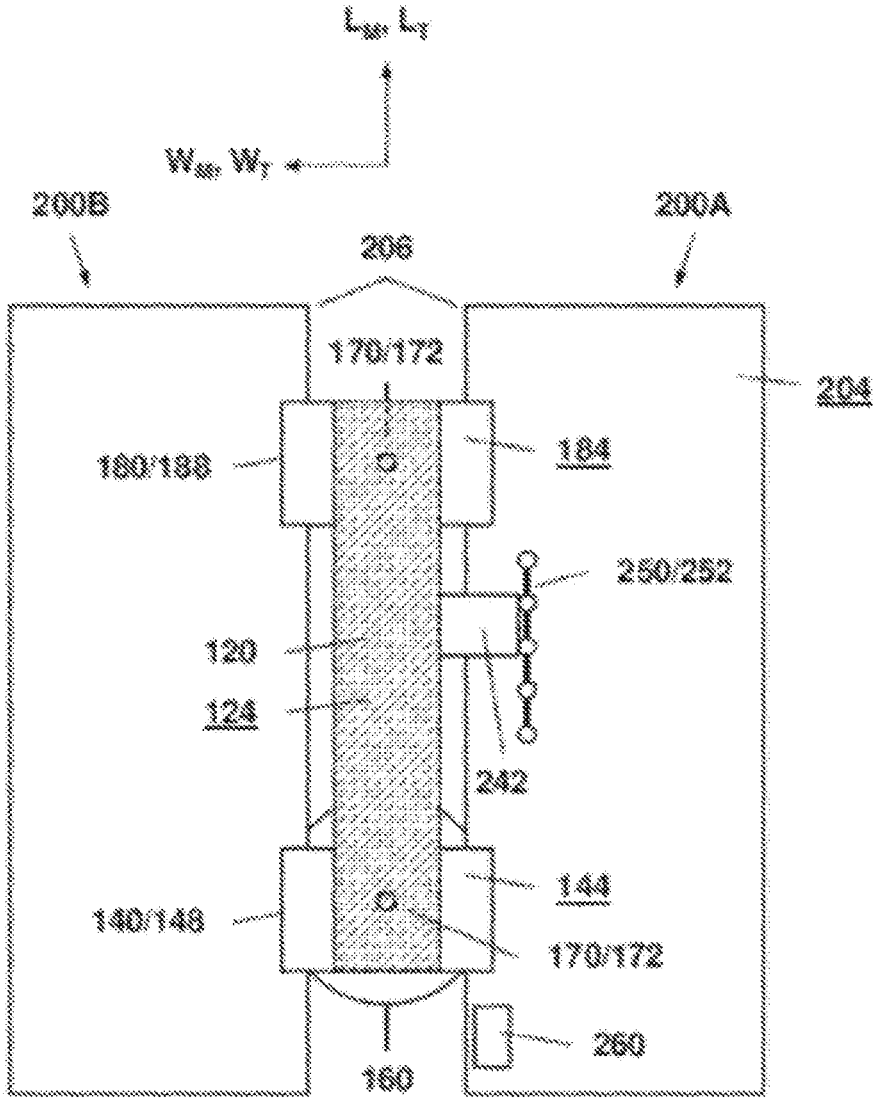
FIG. 4 is a bottom view of the locating assembly in FIG. 2.
Figure 6A:
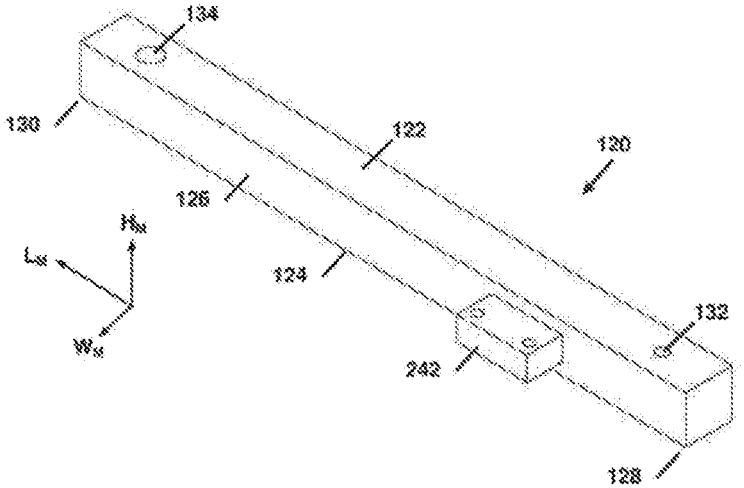
FIGS. 6A-6E are views of the locating assembly components (A: mounting block, B: first and second portions of guide assembly, C: third portion of guide assembly, D: locating block, E: alignment guide).
Figure 6B:
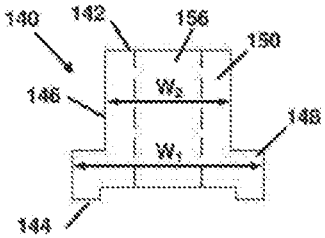
Figure 6C:
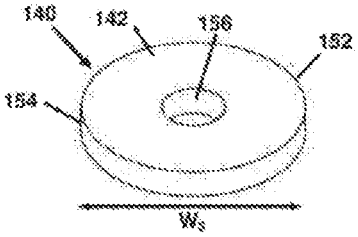
Figure 6D:
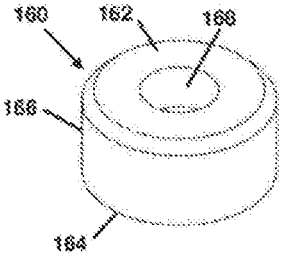
Figure 6E:
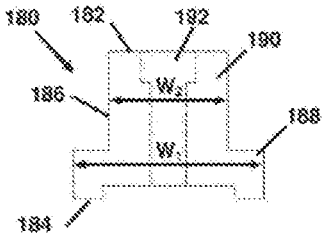

The longitudinal translation means 250 moves the locating assembly 100 in the longitudinal direction L.sub.M or L.sub.T of either or both of the mounting block 120 and the locating table segment 310. The longitudinal translation means is connected to the locating assembly 100 in any convenient fashion, for example via a connector 242 portion of the mounting block 120 (e.g., extending laterally outward as shown in FIGS. 4 and 6A, such as via a weld between a metal/steel connector 242 and chain 252), which is in turn connected to the driver means 270. As shown in the figures, the movement means is suitably mounted to the table segment 200 (e.g., to the bottom surface 204 thereof), but the movement means can be more generally positioned below the table segment 200 bottom surface 204 without being mounted thereto (e.g., the movement means can be mounted to other support structure (not shown) as long as the locating assembly 100 is positioned appropriately relative to the table segment 200).

In the particular embodiment illustrated, the driver means 270 includes a motor 272 mounted to the table segment 200 bottom surface 204 and a sprocket 276 rotationally driven by and operatively coupled to the motor 272 (e.g., via a driven shaft 274 as shown). Suitably, the motor 272 and driven sprocket 276 are mounted at the proximal end 208 of the table segment 200 via one or more mounting plates 278 welded or otherwise secured to the bottom surface 204. As further shown, the longitudinal translation means 250 can include an endless chain 252 extending between the proximal and distal ends 208, 210 of the table segment 200 and is operatively connected to the rotationally driven sprocket 276. For example, a freely rotating sprocket 254 can be mounted at the distal end 210 of the table segment 200 via a mounting bracket 256 (e.g., which can be itself mounted to another mounting plate 278) and a pin 255 for rotatably mounting the sprocket 254 to the bracket 256, and the chain 252 can be secured at both ends by the free and driven sprockets 254, 276. Suitably, the mounting bracket 256 is adjustable in the longitudinal direction (e.g., via a bolt 280 that can be tightened or loosened) to permit the adjustable selection of the tension in the chain 252 to a desired value so that a revolution counter or servo unit in the motor 272 can be calibrated to control the precise location of the locating assembly 100 along the table segment 200 length during operation. Thus, the mounting block 120 can be mounted to the outside edge of the chain 252 such that rotational motion of the motor 272/shaft 274/driven sprocket 276 results in longitudinal translational motion of the chain 252 and the locating assembly 100 (e.g., in either direction depending on the direction of rotation). In another embodiment (not shown), the driver means 270 (e.g., motor 272 and driven sprocket 276) could be positioned intermediate the proximal and distal ends of the longitudinal translation means 250/chain 252, for example with a free sprocket anchored to each end of the chain 252 and where the driven sprocket 276 engages the inside edge of the chain 252 as some point intermediate the ends. In some embodiments, a stop (e.g., a rod or plate) can be mounted to a bottom outside edge of the table segment 200 near to the free and/or driven sprockets 254, 276 to prevent the locating assembly 100 from approaching the sprockets during use. As further shown, a chain guard 258 can be mounted to the bottom surface 204 of the table segment 200 such that the guard 258 divides the outside and inside edges of the chain 252 over at least part of the chain's extent and optionally provides a lip portion beneath the chain 252 to limit any undesired sagging of the chain 252 throughout its extended life.

Figure 7:
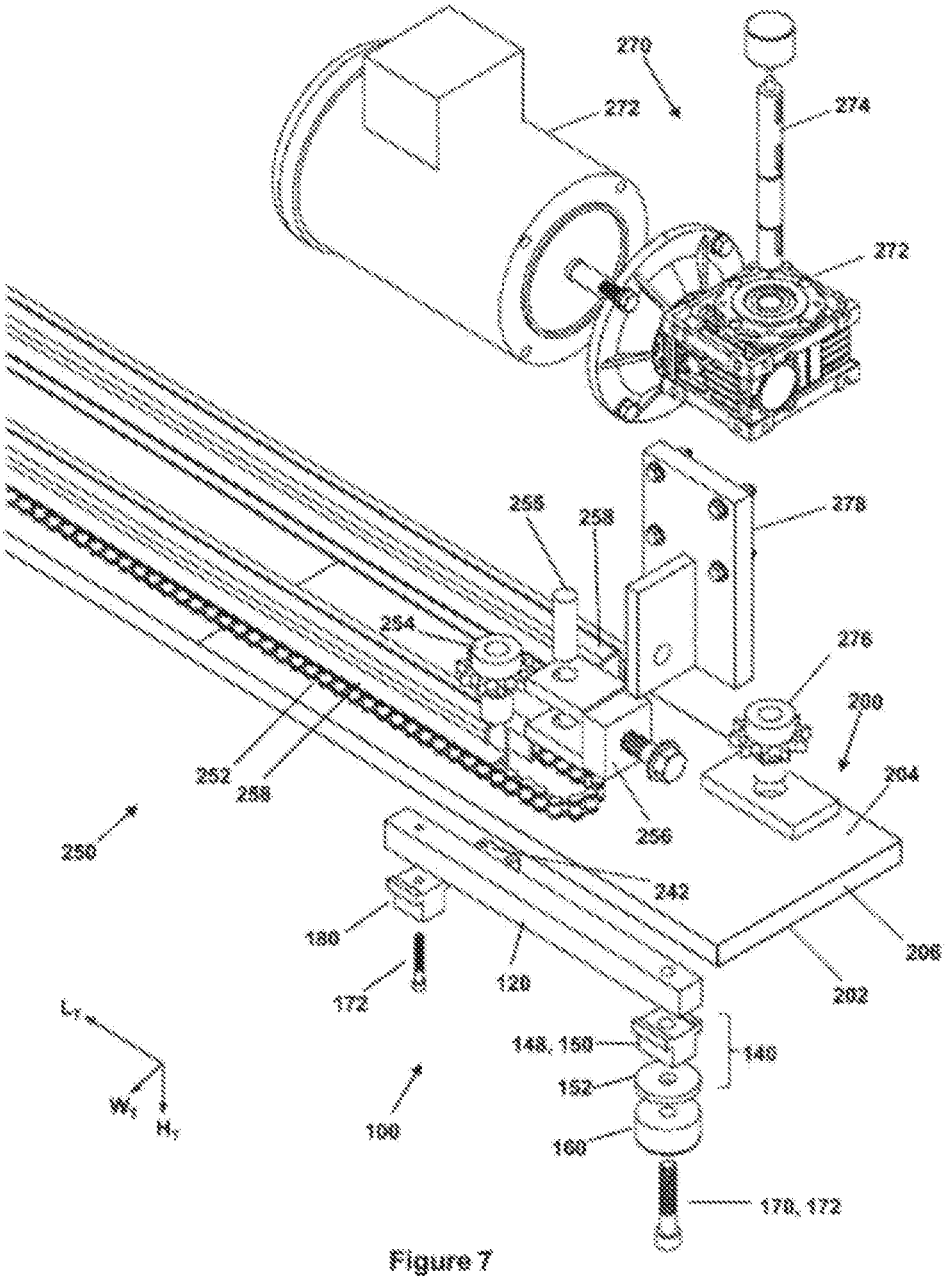
FIG. 7 is an exploded bottom perspective view of a locating table segment according to the disclosure.
Figure 8:
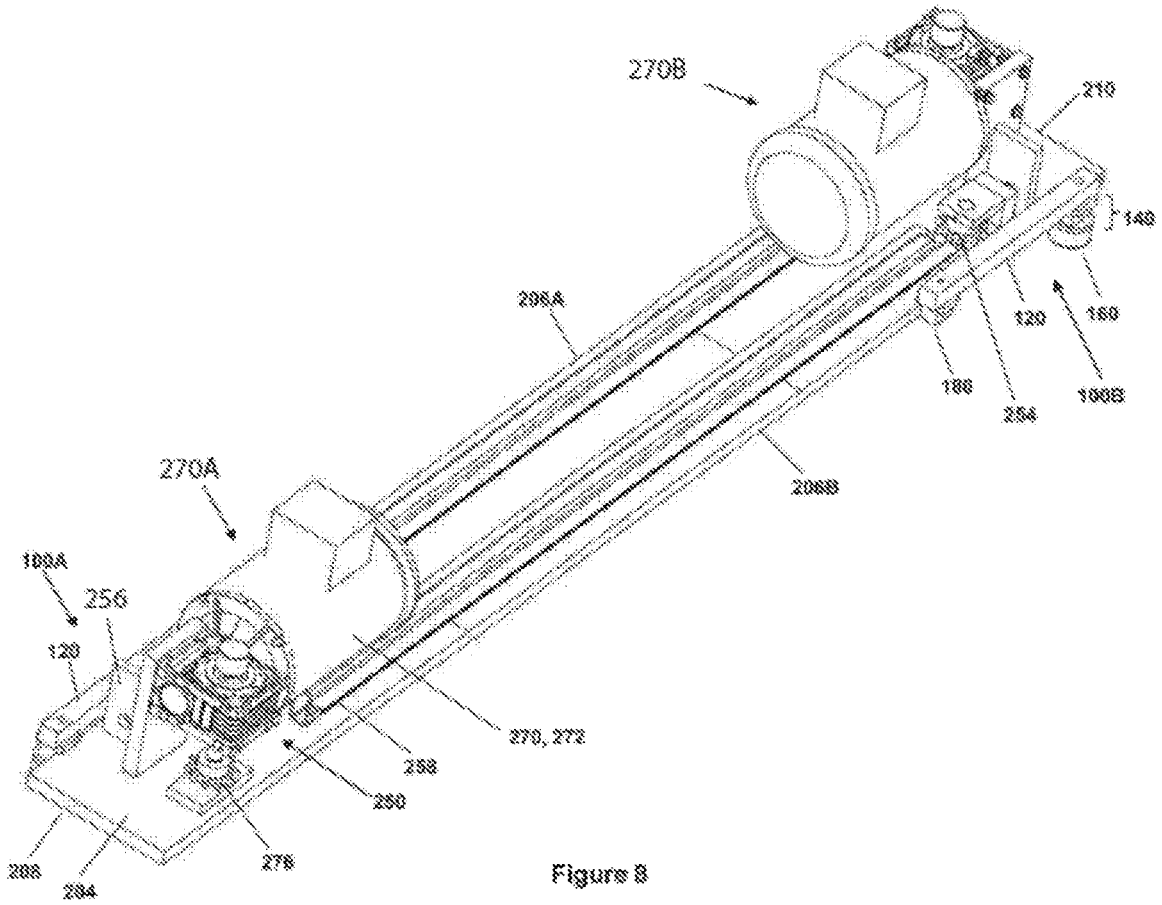
FIG. 8 is a bottom perspective view of a locating table segment according to the disclosure.

The locating table segment 310 includes at least one driver means 270 and at least one locating assembly 100. In an embodiment, the locating table segment 310 can have only a single locating assembly 100 and a single driver means 270 (e.g., mounted thereto), such that only one side surface 206 of the table segment 200 has an associated locating assembly 100, In the illustrated embodiment of FIG. 8, however, the locating table segment 310 can have (i) a first locating assembly 100A and a first driver means 270A mounted thereto, with the first locating assembly 100A being positioned adjacent a first side surface 206A of the table segment 200, and (ii) a second locating assembly 100B and a second driver means 270B mounted thereto, with the second locating assembly 100B being positioned adjacent a second side surface 206B of the table segment 200 that opposes the first side surface 206A (e.g., in the width direction W.sub.T). For example, as particularly seen in FIG. 8, the locating table segment may comprise two movement means. A first movement means including a driver means 270 (e.g., including a motor 272 and driven sprocket 276) mounted to the proximal end 208 of the bottom surface 204, while its longitudinal translation means 250 (e.g., chain 252 as seen in FIG. 7) extends along the edge length of the table segment 200 where it is anchored at the distal end 210 (e.g., via a free sprocket 254). Conversely, the second movement means a can include another driver means 270 mounted to the distal end 210 of the bottom surface 204, while its longitudinal translation means 250 (e.g., another chain 252) extends along the opposing edge length of the table segment 200 where it is anchored at the proximal end 208 (e.g., via another free sprocket 254).

Attachment Brackets

Blank Table segments 320 and locating table segments 310 may be supported by attachment brackets 903, an embodiment of which is depicted in FIGS. 9 and 16-20. The depicted embodiment of the attachment bracket includes a L-bracket 1001 having a hole 1002 through which a pin, bolt, rivet of other fastening device 1004 may be inserted to secure a blank table segment 320 and/or locating segment 310. Attached to L-bracket 1001 is spacer 1003 allowing L-bracket 1001 to be secured to I-beam 902 such that the top of L-bracket 1001 is at least flush with, if not above, the top of I-beam 902. In the illustrated embodiment of FIGS. 10-13 table segments also have end holes 920 at the ends of the table segments to allow attachment of the table segment to the table frame 901 with fastening means 940 which may include screws, pins and/or bolts. Additionally inner holes 930 may also be provided to allow table segments to be attached to an attachment bracket attached to one of the I-beams. It is noted that attachment bracket 903 is shown on every I-beam for illustrative purposes only.

Figure 16:
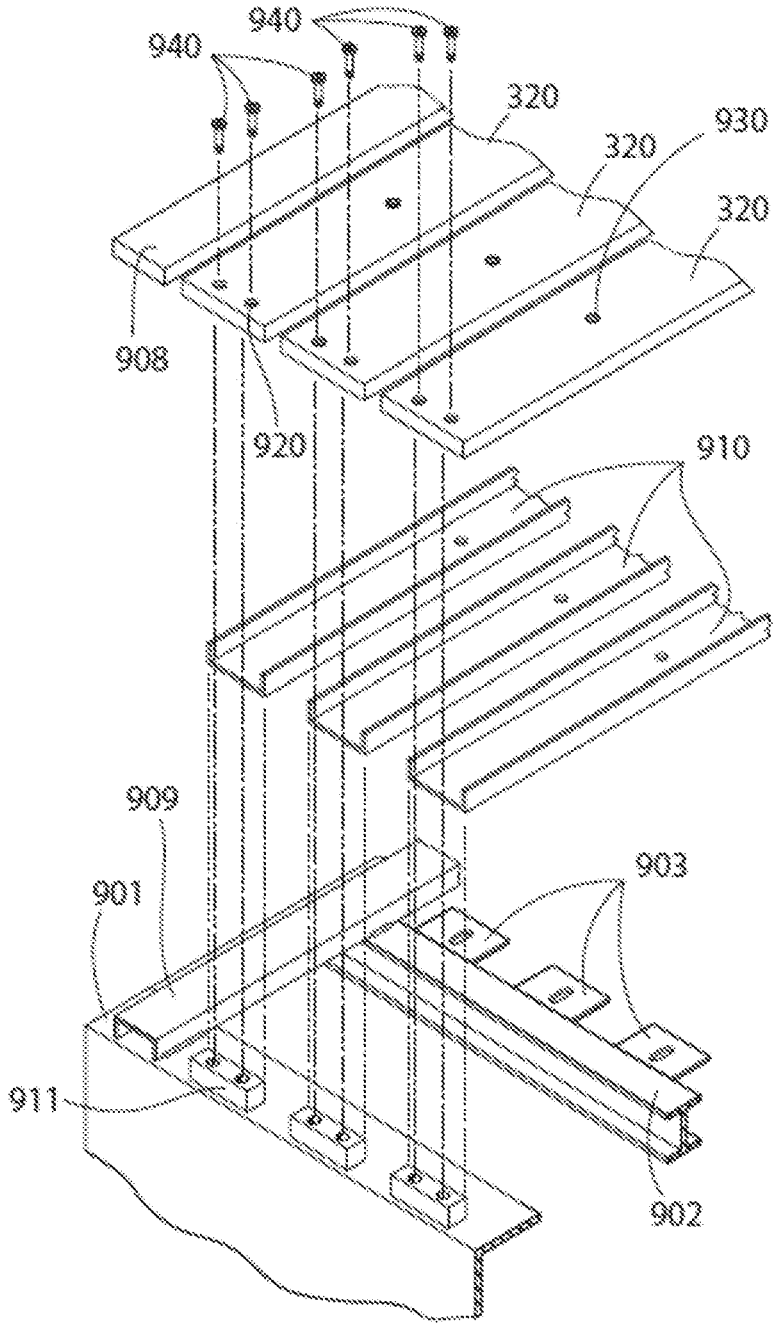
FIG. 16 represents a top perspective partial view of a frame of one embodiment of the table assemblies showing attachment of table segments.
Figure 17:
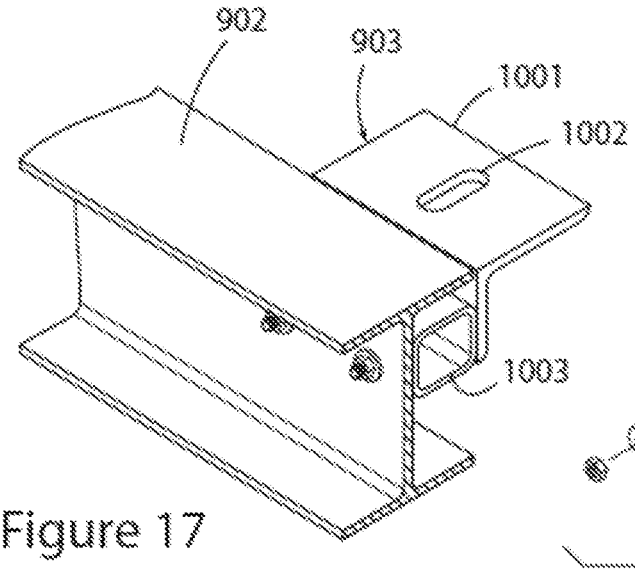
FIG. 17 shows an illustrative attachment bracket of FIG. 9 to attach a table segment onto a beam of the table assemblies.
Figure 18:
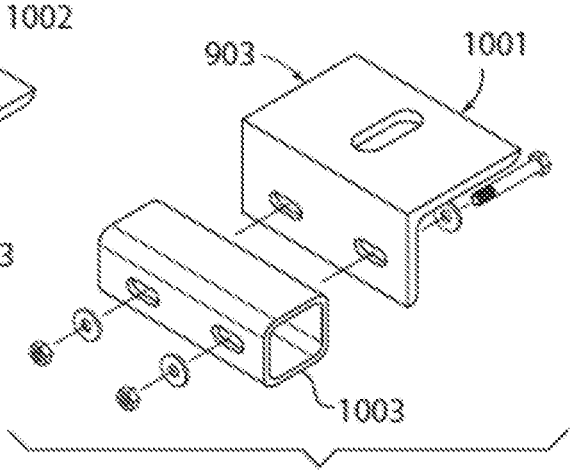
FIG. 18 shows an exploded perspective view of an illustrative attachment bracket of FIG. 9 to attach a table segment onto a beam the table assemblies.
Figure 19:
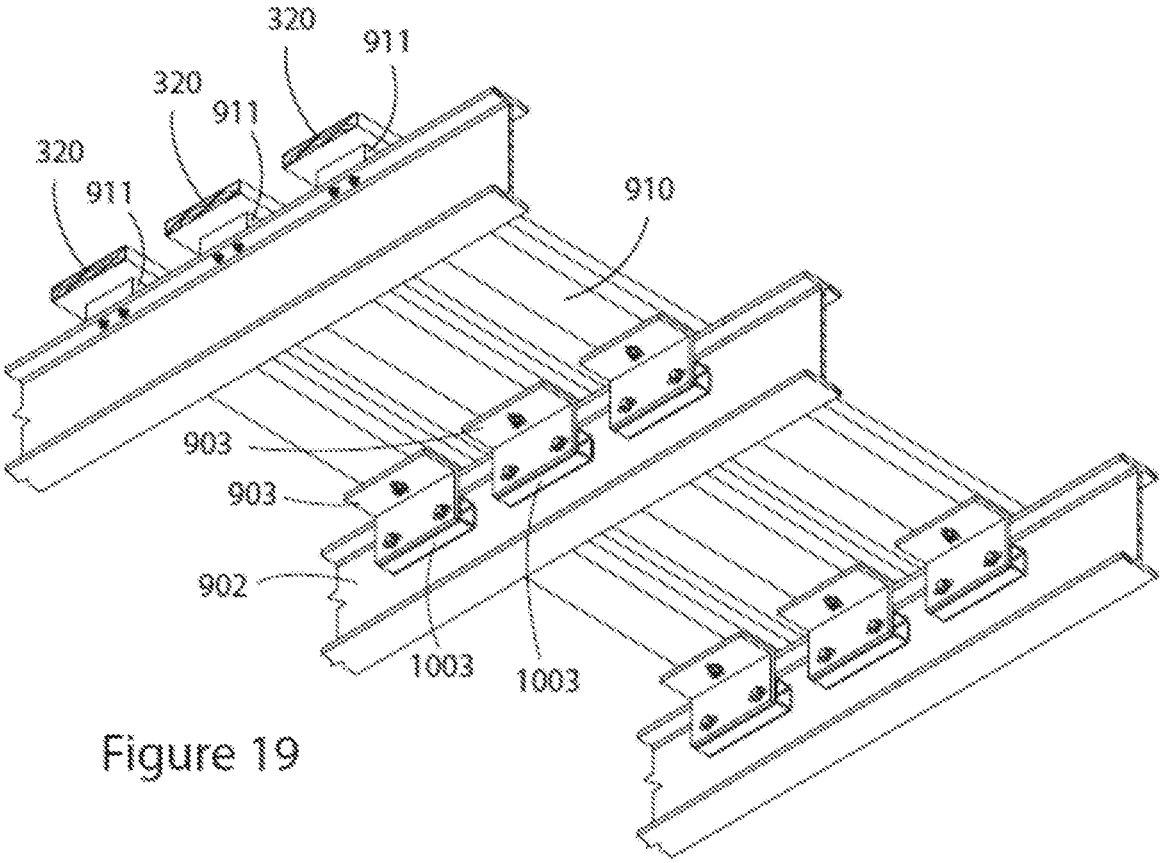
FIG. 19 shows a bottom perspective view of blank table segments attached onto beams of a table assembly.
Figure 20:
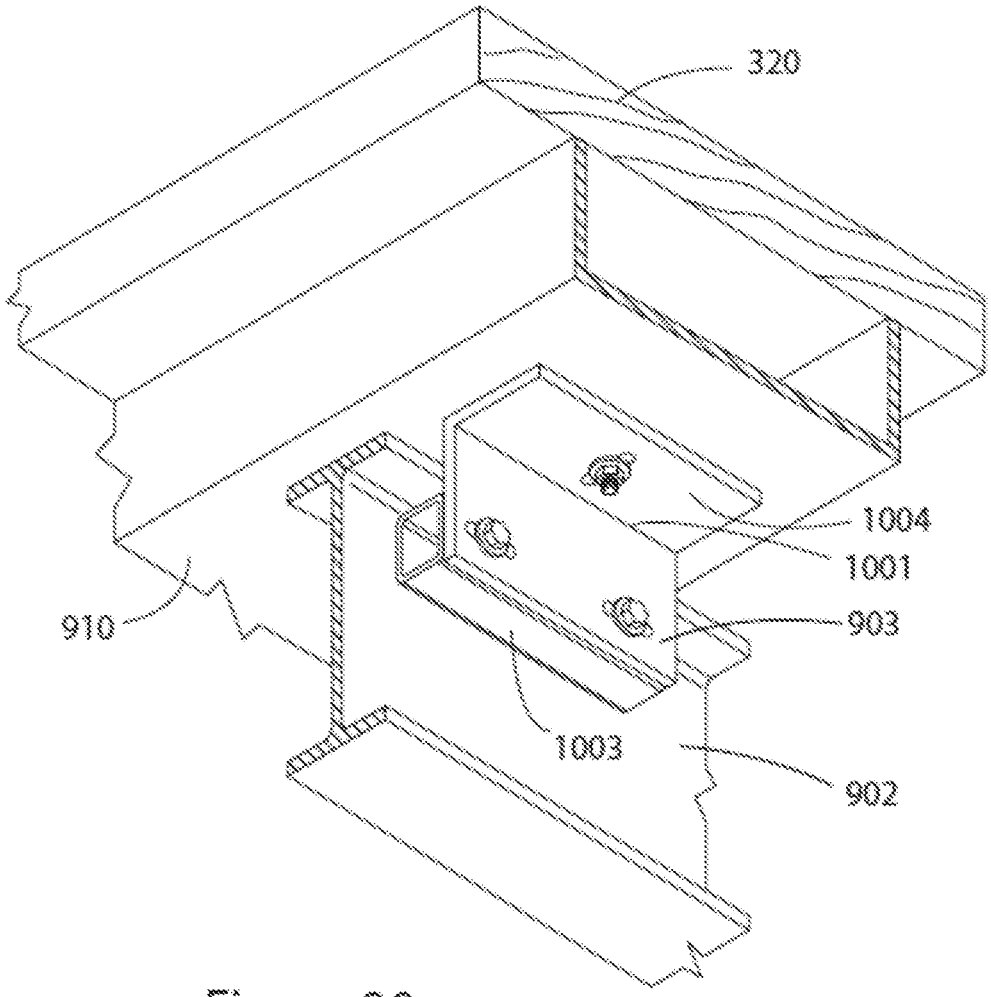
FIG. 20 shows a bottom perspective view of one attachment bracket attaching a blank table segment onto a beam of a table assembly.
Figure 21:
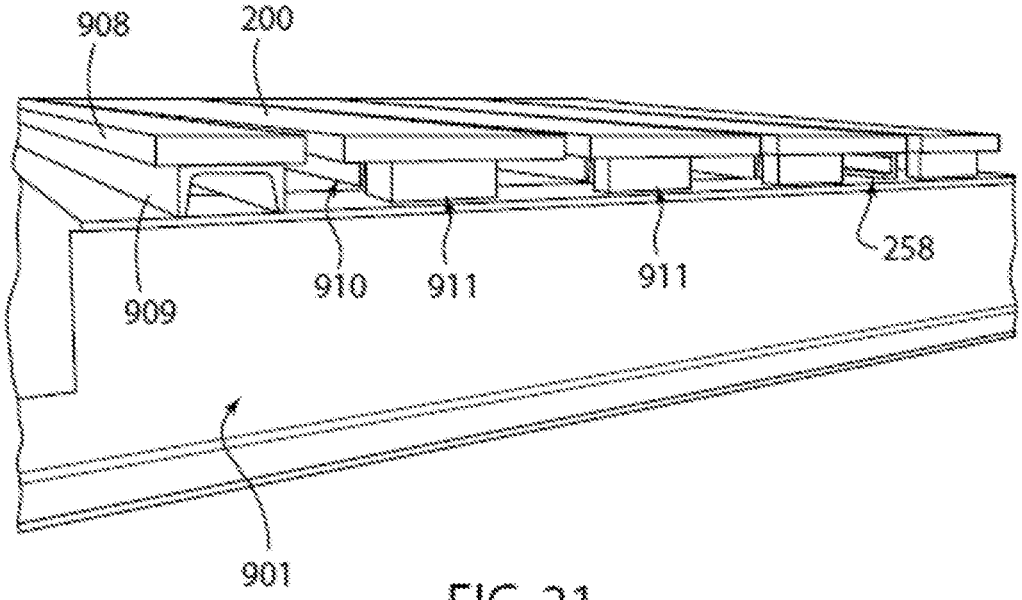
FIG. 21 represents a front perspective partial view of table segments attached to a table assembly.

For illustrative purposes, the end holes 920 and/or inner holes 930 can be arrayed and separated based on a variety of factors such as the width of the table segment or the predetermined positions of attachment holes on frame 901, such as shown in FIG. 9. For example, if a blank table segment 320 had a width 910 of 8 inches, the distance 914 between end holes 920 can be between 3 to 4 inches In some embodiments the blank table segments 320, locating table segments 310 and/or half table segments 908 may have a table segment beam 909/910 mounted to the beams 902 and/or table frame 901, as shown in FIGS. 16, 19, 20 and 21. In some embodiments, such as shown in FIG. 21, a locating table segment may be mounted to the table such that its chain guard 258 is positioned analogous to table segment beam 910. At the end of the end of table segments beam 909/910 of the table segments 310/320/908 may be positioned a block 911. Table segments beams 909/910 of the table segments 310/320/908 may be square and/or u-shaped (with its legs directed upward or downward for its base), as shown in FIGS. 16, 19 and 20, or any other shape.

Truss Assembly System

FIG. 1 illustrates the truss assembly system 300 according to the disclosure and its related method of use. The system 300 generally includes a first table segment (which is a locating table segment 310 according to any of its various embodiments) and a second table segment (which can be an additional locating table segment 310 or a blank table segment 320). The locating assembly 100/mounting block 120, the first table segment 310, and/or the second table segment 310/320 are suitably arranged to be parallel or substantially parallel (e.g., as characterized by the longitudinal direction of each, for example to within a machining tolerance such as not more 1.degree., 0.5.degree., 0.2.degree., or 0.1.degree.). The first table segment 310 and the second table segment 310/320 are spaced apart to define a slot 330 between adjacent side surfaces 206 of the table segments. The slot 330 has a shape and cross section complementary to that of the second portion 150 of the guide assembly 140. In a general sense, the second portion 150 of the guide assembly 140 freely fits in the slot 330, in particular such that the second width W.sub.2 is not more than the slot 330 width at all relevant points within the slot 330 where the locating assembly 100 is intended to operate/traverse. Suitably, the second width W.sub.2 is substantially the same as the slot 330 width at all relevant points so that locating assembly 100 is stabilized against undesired lateral movement in the width direction W.sub.M as it is positioned at various points along the length of the table segment 200 (e.g., the second width W.sub.2 is the same as or slightly smaller than the slot 330 width to reduce unnecessary friction but to provide the desired lateral stability). Additionally, the slot cross section in the longitudinal direction L.sub.M can be the same as that of the second portion 150 at points thereof adjacent to or in contact with the table segment 200 sidewalls 206 defining the slot 330.

More specifically, the first portion 148 of the guide assembly 140 is below the first and second table segment 310, 320 bottom surfaces 204, for example where a segment such as a lip or flange section of the first portion 148 extends below the table segments 310, 320 and can be in contact with or next to each bottom surface 204, with or without any intervening structure. Similarly, the third portion 152 of the guide assembly 140 is above the first and second table segment 310, 320 top surfaces 202, for example where a segment such as a lip or flange section of the third portion 152 extends above the table segments 310, 320 and can be in contact with or next to each top surface 202, with or without any intervening structure. The second portion 150 of the guide assembly 140 is disposed in the slot 330 and is adjacent the first and second table segment 310, 320 side surfaces 206, for example where all or some of the side surface 146 of the guide assembly 140 second portion 150 is in contact with or next to each side surface 206, with or without any intervening structure. Accordingly, the mounting block 120 is below both the table segment 310, 320 bottom surfaces and the first portion 148 of the guide assembly 140, and the locating block 160 is located above the table segment 310, 320 top surfaces 202 and the third portion 152 of the guide assembly 140.

The truss assembly system 300 suitably includes a plurality of first and second table segments 310, 320 positioned adjacent each other (e.g., in alternating fashion between a first table segment 310 and a second table segment 310, 320). The collective top surfaces 202 of the table segments 310, 320 thus define a top table surface that includes a plurality of slots 330 each having an independently positionable locating assembly 100 therein. The plurality of independently positionable locating assemblies 100 permits the system 300 to define an outline via the blocks 160 corresponding to a potentially large and/or intricate geometric shape of a desired truss 400 to be assembled.

The truss assembly system 300 can further include a computer control system 350 that is operatively connected (e.g., electronically) to any or all of the movement means 240 in the truss assembly system 300. The computer control system 350 allows the particular longitudinal position of each locating assembly in the system 300 to be independently selected by a user, and the control system 350 then interfaces with/controls each movement means 240 to move the locating assemblies 100 to the selected positions. Computer software and hardware (e.g., memory, processor, user interface, electro-mechanical interface) for the control system 350 is conventionally available. In the illustrated embodiments, a revolution counter or servo unit incorporated in the motor 272 is calibrated to control the precise location of the locating assembly 100 insofar as a rotation count of the shaft 274/driven sprocket 276 can be directly correlated to a longitudinal translational movement of the chain 252 and the locating assembly 100 mounted thereto. In the illustrated chain-and-sprocket embodiment, the absence of any slippage between components of the movement means 240 results in the precise determination and control of the locating assembly 100 longitudinal position. In some embodiments, the movement means 240/control system 350 can include electronic overload protection (e.g., which can monitor the instantaneous electrical current being consumed to drive the movement means 240 as well as terminate the movement means 240 operation if desired, for example when the current exceeds a selected threshold level that could indicate the presence of an obstruction to further locating assembly 100 movement.

In an embodiment, the truss assembly system 300 can further include a motion or proximity sensor 262. The sensor 262 can be mounted in any convenient location in the system 300 so that it is capable of detecting the motion and/or presence of the locating assembly 100 or a component thereof. For example, as illustrated in FIG. 1, the sensor 262 can be mounted on the bottom surface 204 of the table segment 200 so that it extends into the slot 330, such as in the vicinity of the stop 260 and the sprocket 254 or 276. As shown in FIG. 1, a pair of sensors 262 are mounted near opposing side surfaces 206, one at or near the proximal end 208 and one at or near the distal end 210 of the table segment 200 (e.g., where a table segment 200 has one sensor 262 for each movement means 240 mounted thereto). A suitable sensor 262 is an inductive proximity sensor that senses metal (e.g., a metal mounting block 120 or a metal locating block 160 as a component of the locating assembly 100), for example as available from Aotoro (Zhejiang, China). In the illustrated embodiment, the sensor 262 has a line of sight (indicated by arrows) that is aimed along the length of the slot 330 and is vertically positioned so that it detects the presence of a metal mounting block 120 as the locating assembly 100 approaches the stop 260.

The sensor(s) 262 can be operatively connected (e.g., electronically connected) to either or both of the movement means 240 and the computer control system 350. The presence and/or motion of the locating assembly 100 can be detected as the locating assembly 100 approaches the proximal or distal ends 208, 210 of the table segment 200 (e.g., near the stop 260 or sprocket 254/276, such as within about 0.5 cm or 1 cm to about 2 cm or 5 cm of the stop or sprocket). The sensor 262 provides a feedback to the movement means 240/computer control system 350, which in turn signals the driver means 270/motor 272 to substantially reduce the speed of the locating assembly 100. At the substantially reduced speed, the locating assembly 100 can further progress until it impacts the stop 260. The low-speed impact prevents jamming or other disruption of the movement means 240. Further, when the stop 260 is located at a known (e.g., fixed) position along the length of the table segment 200, the impact can be used to accurately calibrate the internal length positioning system of the truss assembly system 300 (e.g., within the computer control system 350). For example, prior to use of the system 300 for truss 400 assembly (e.g., when there are no truss segments 410/420 placed on the table), the locating assembly 100 can be traversed along the length of the table segment 200 until it then experiences the low-speed impact with the stop 260 near the sensor 262 (e.g., in the vicinity of the corresponding driver means 270/motor 272). The known position of the stop 260 permits rapid, precise, automatic calibration of the locating assembly's 100 position along the longitudinal length of the table 200 (e.g., in combination with the revolution counter or servo unit incorporated in the motor 272 as described above).

The particular arrangement of first and second table segments 310, 320 is not particularly limited, and the table segments can be suitably selected such that each desired slot 330 includes a locating assembly 100 (e.g., a single assembly per slot). In an embodiment, each of the first and second table segments 310, 320 can be locating table segments 310. In the context of FIG. 1, this embodiment is represented with the middle and right-most table segments being locating table segments 310, each with a single movement means 240A and a single locating assembly 100A. A blank table segment 320 can be incorporated into the system 300 where no locating assembly 100 is desired (e.g., as in the terminal table segment illustrated by the left-most table segment in FIG. 1). In another embodiment, the first and second table segments 310, 320 can alternate such that the first table segment is a locating table segment and the second table segment is a blank table segment 320. The blank table segment 320 generally has no locating assembly 100 (although it may be coupled with a locating assembly 100 of an adjacent locating table segment 310), for example representing a single table plank/segment that has no movement means 240 or locating assembly 100 mounted thereto. In the context of FIG. 1, this embodiment is represented with the middle table segment being a locating table segment 310 that includes dual movement means 240 and dual locating assemblies 100A/100B on opposing sides of the table segment 200, while the left- and right-most table segments are blank table segments 320.

Figure 14:
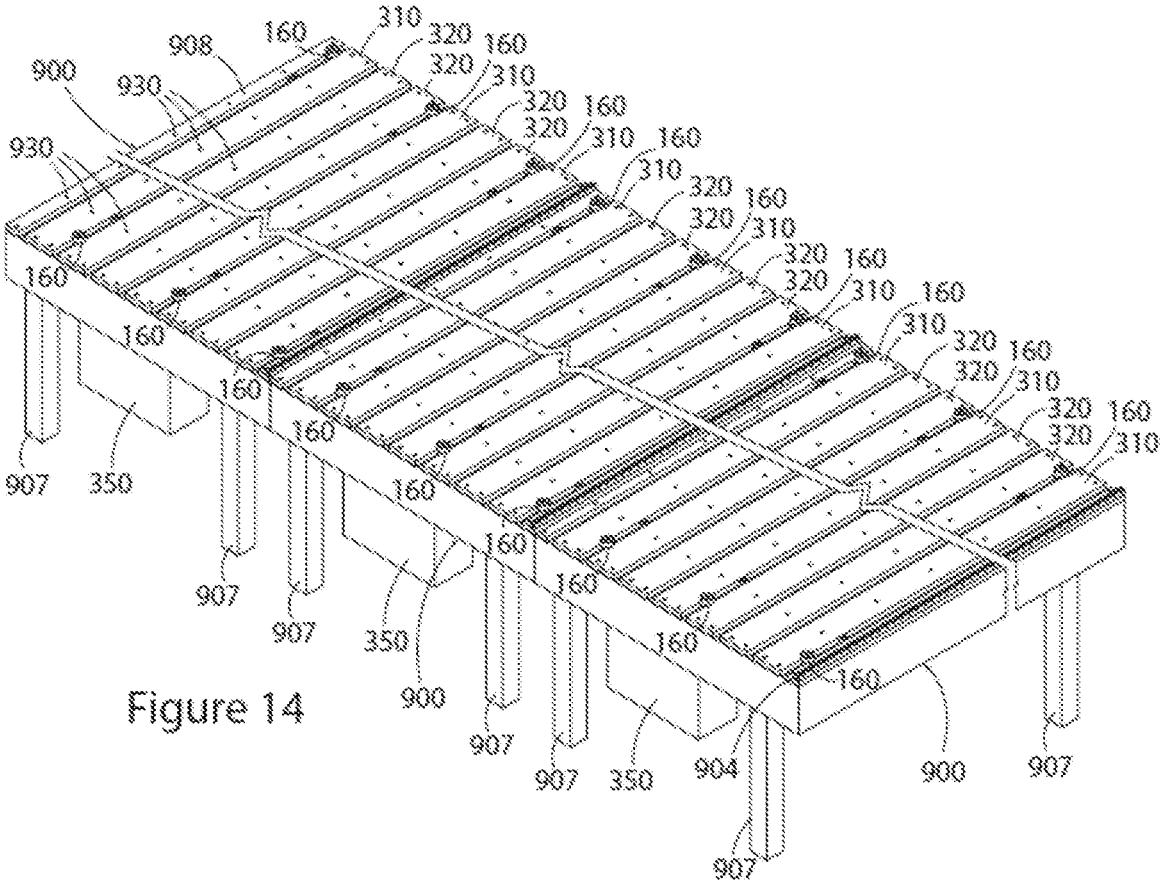
FIG. 14 is an array of adjacent table assemblies having two blank table segments between each of the locating table segments.
Figure 15:
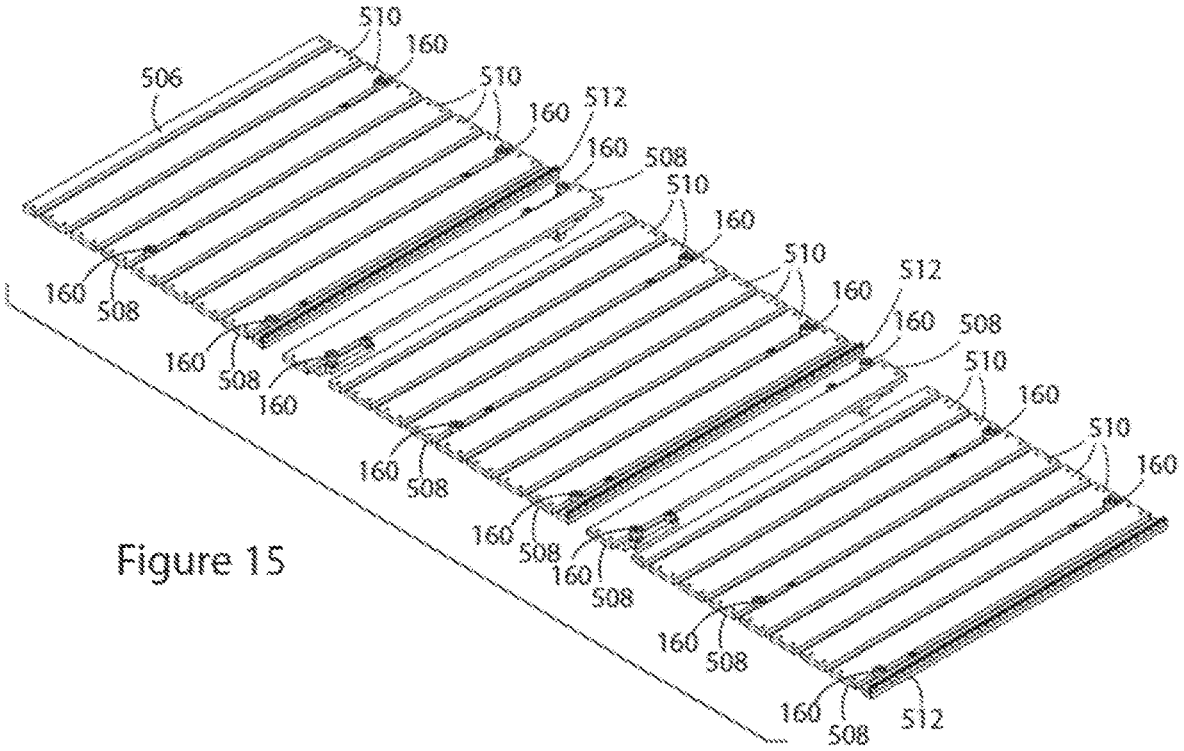
FIG. 15 is an array of table tops of adjacent table assemblies having four blank table segments between each of the locating table segments and roller segments at adjacent edges of the table tops flanked by locating table segments.

By way of further example, FIGS. 14 and 15 show such table segment arrays. In some embodiments the desired distance between locating blocks 160 is considered. Here, the table segment width and spacing of locating blocks 160 can be, for illustrative purposes only, 24, 32 40 or 48 inches on center.

FIG. 1 further illustrates a method of assembling a construction truss 400 using the truss assembly system 300 (in particular in an embodiment with multiple locating assemblies 100). Each of the locating assemblies 100 in the system 300 is first positioned to correspond to a shape (e.g., outline) of a desired construction truss 400 (e.g., building or roof truss). The truss 400 is generally a planar truss and its shape is not particularly limited. The system 300 can be appropriately sized (e.g., in terms of both physical dimensions and number of locating assemblies 100) to accommodate any desired shape, for example including a triangle, trapezoid, or any other general triangular, rectangular, or polygonal shape, regular or irregular, symmetric or asymmetric). The particular locations of the locating assemblies 100 are generally selected by a user, for example using the computer control system 350 (e.g., where specific locations can be input by the user and/or retrieved from a database of pre-set truss 400 geometries) to activate the movement means 240 and move the assemblies 100. A plurality of truss segments 410 (e.g., pre-cut segments of appropriate size, shape, and length depending on the final truss 400 shape/size) are then placed on the table surface (e.g., manually by a user) in the shape defined by the locating assemblies 100. If desired, interior truss support segments 420 can be positioned within the interior of the shape defined by the locating assemblies 100 (e.g., to provide additional structural support to the eventual truss 400). The truss segments 410, 420 are then fastened together (e.g., manually by a user) to form an assembled truss 400 using any desired fastening means 412 (e.g., nails, nail plates, screws) suitable for the particular truss segment material used. The assembled truss 400 is then removed from the table surface, at which time the locating assembly 100 positions can be repositioned for a new truss 400 geometry, or the existing locating assembly 100 positions can be used to construct another truss 400 having the same geometry as the previous truss 400.

Because other modifications and changes varied to fit particular operating requirements and environments will be apparent to those skilled in the art, the disclosure is not considered limited to the examples chosen for purposes of illustration, and covers all changes and modifications which do not constitute departures from the true spirit and scope of this disclosure.

Accordingly, the foregoing description is given for clarity of understanding only, and no unnecessary limitations should be understood therefrom, as modifications within the scope of the disclosure may be apparent to those having ordinary skill in the art.

Throughout the specification, where the processes, apparatus, or systems are described as including components, steps, or materials, it is contemplated that the processes, apparatus, or systems can also comprise, consist essentially of, or consist of, any combination of the recited components or materials, unless described otherwise. Numerical values and ranges can represent the value/range as stated or an approximate value/range (e.g., modified by the term "about")

LIST OF FIGURE ELEMENTS

100 Locating assembly
100A/B First/second locating assembly
120 Mounting block
122 Top surface
124 Bottom surface
126 Side surfaces
128 Proximal end
130 Distal end
L.sub.M Longitudinal direction
W.sub.M Width direction
H.sub.M Height direction
132 First receiving hole
134 Second receiving hole
140 Guide assembly
142 Top surface
144 Bottom surface
146 Side surfaces
148 First portion
W.sub.1 First width
150 Second portion
W.sub.2 Second width
152 Third portion
W.sub.3 Third width
154 Cylindrical spacer/washer
156 Receiving hole
158 Receiving portion
160 Locating block
162 Top surface
164 Bottom surface
166 Side surfaces
168 Receiving hole
170 Compression/fastening means
172 Bolt/threaded rod
F Compression force
180 Alignment guide
182 Top surface
184 Bottom surface
186 Side surfaces
188 First portion
W.sub.1 First width
190 Second portion
W.sub.2 Second width
192 Receiving hole
200 Table segment
200A/B First/second table segments
202 Top surface
204 Bottom surface
206 Side surfaces
208 Proximal end
210 Distal end
L.sub.T Longitudinal direction
W.sub.T Width direction
H.sub.T Height direction
240 Movement means
240A/B First/second movement means
242 Connector to locating assembly
250 Longitudinal translation means
252 Chain
254 Free Sprocket
255 Pin
256 Mounting Bracket
258 Chain guard
260 Stop
262 Proximity Sensor
270 Driver means
272 Motor
274 Shaft
276 Driven sprocket
278 Mounting plate
280 Bolt
300 Truss assembly system
310 Locating table segment
320 Blank table segment
330 Slot
350 Computer control system
400 Truss
410 Truss segment
412 Fastener means
420 Truss support segment
900 Table assembly
901 Frame
902 Beam
903 Attachment bracket
904 Roller segment
905 Mounting hole
906 Mounting hole
907 Leg
908 Half-width table segment
909 Half table segment beam
910 Table segment beam
911 Block
920 End holes
930 Inner holes
1001 L-bracket
1002 Hole
1003 Spacer
1004 Fastening device

I claim:

1. A truss jigging system comprising:

a table having a plurality of table segments forming a support plane on which truss pieces are supported and extending between a first edge and a spaced-away second edge, thereby defining a front to back direction, and being elongated side to side between a left side edge and a spaced-away right side edge;

the table being formed with a plurality of elongated, narrow surface slots through the support plane and extending on generally parallel axes to each other in the front to back direction between the plurality of table segments, the surface slots being recessed down in the table to widen out to form slideways that are spaced below the support plane and correspondingly are elongated and extend generally parallel with the same axis as the respective surface slot;

a locating assembly having a plurality of locating pins, a plurality of carriages for not only inserting into the slideways for sliding transit therein but also for carrying one of the plurality of locating pins for sliding transit therewith while the locating pin extends through the surface slot and protrudes above the support plane, the plurality of carriages having a portion extending underneath the plurality of table segments to mount to a carriage movement means, the carriage movement means for each of the plurality of carriages being positioned entirely below the respective one of the plurality of table segments, wherein each of the carriage movement means has an endless belt;

an idler wheel disposed proximate the first edge of table to service a respective one of the slideways;

a drive wheel disposed proximate the opposite second edge of table; and a driver motor to drive the drive wheel.

2. The truss jigging system of claim 1, wherein each one of the endless belts is strung around a respective one of the idler wheels and a respective one of the drive wheels such that each one of the endless belts comprises a pair of elongated runs, one of the runs being an elongated return run between the respective drive wheel and idler wheel, and the other run being spaced and opposite to the one run, said other run having a respective one of the carriages affixed thereto and coursing through the respective slideway that the respective drive wheel and idler wheel service, such that, driving the drive wheel moves the locating pin back and forth along an axis in a front to back direction.

3. The truss jigging system of claim 2, wherein the endless belt is an endless chain, the idler wheel is a freely rotating geared sprocket, and the drive wheel is a driven geared sprocket driven by the drive motor.

4. The truss jigging system of claim 2, wherein at least one of the plurality of table segments has two locating assemblies, one disposed for left side edge and the other for the right side edge.

5. The truss jigging system of claim 4, wherein the at least one of the plurality of table segments having two locating assemblies are spaced between alternating table segments at least one of the plurality of table segments has two locating assemblies, one disposed for left side edge and the other for the right side edge.

* * * * *